US010632434B2

(12) United States Patent
Veit

(10) Patent No.: US 10,632,434 B2
(45) Date of Patent: Apr. 28, 2020

(54) APPARATUS FOR ACCOMMODATION AND DISPENSING OF MISCIBLE MATERIALS HAVING DISCHARGE OPENING PROVIDED WITH A DISPLACER APPARATUS

(71) Applicant: Herbert Veit, Osann-Monzel (DE)

(72) Inventor: Herbert Veit, Osann-Monzel (DE)

( * ) Notice: Subject to any disclaimer, the term of this patent is extended or adjusted under 35 U.S.C. 154(b) by 225 days.

(21) Appl. No.: 15/117,749

(22) PCT Filed: Feb. 17, 2015

(86) PCT No.: PCT/EP2015/053333
§ 371 (c)(1),
(2) Date: Aug. 10, 2016

(87) PCT Pub. No.: WO2015/169458
PCT Pub. Date: Nov. 12, 2015

(65) Prior Publication Data

US 2016/0354743 A1 Dec. 8, 2016

(30) Foreign Application Priority Data

May 6, 2014 (EP) ..... 14167217

(51) Int. Cl.
*B01F 15/02* (2006.01)
*B01F 7/16* (2006.01)
(Continued)

(52) U.S. Cl.
CPC ..... *B01F 15/0276* (2013.01); *B01F 7/00158* (2013.01); *B01F 7/00208* (2013.01);
(Continued)

(58) Field of Classification Search
CPC ..... B01F 15/0276; B01F 15/0254; B01F 15/00538; B01F 7/00408; B01F 7/166;
(Continued)

(56) References Cited

U.S. PATENT DOCUMENTS 1,101,199 A * 6/1914 Legg et al. ..... B01F 7/1635 222/229
1,355,305 A * 10/1920 Bowen et al. .... B01F 15/00785 366/194
(Continued)

FOREIGN PATENT DOCUMENTS

DE 2055579 A1 * 5/1972 ..... B01F 15/00779
DE 9401076 U1 * 3/1994 ..... B01F 7/025
(Continued)

OTHER PUBLICATIONS

International Search Report of PCT/EP2015/053333, dated Jun. 1, 2015.

*Primary Examiner* — Charles Cooley
(74) *Attorney, Agent, or Firm* — Collard & Roe, P.C.

(57) ABSTRACT

An apparatus for accommodation and dispensing of miscible materials has an accommodation vessel having a lower region in the form of a truncated cone, with a lower discharge opening in the direction of gravity, and ha a mixing mechanism shaft disposed centrally in a mixing space, which shaft has at least one mixing mechanism that revolves in the accommodation vessel. The discharge opening is provided with a displacer apparatus that projects into the interior of the lower region of the accommodation vessel. The lower end of the mixing screw or mixing spiral of the mixing mechanism projects into the approximately V-shaped channel between the lower vessel wall and the displacer apparatus.

19 Claims, 36 Drawing Sheets

Figure 1:
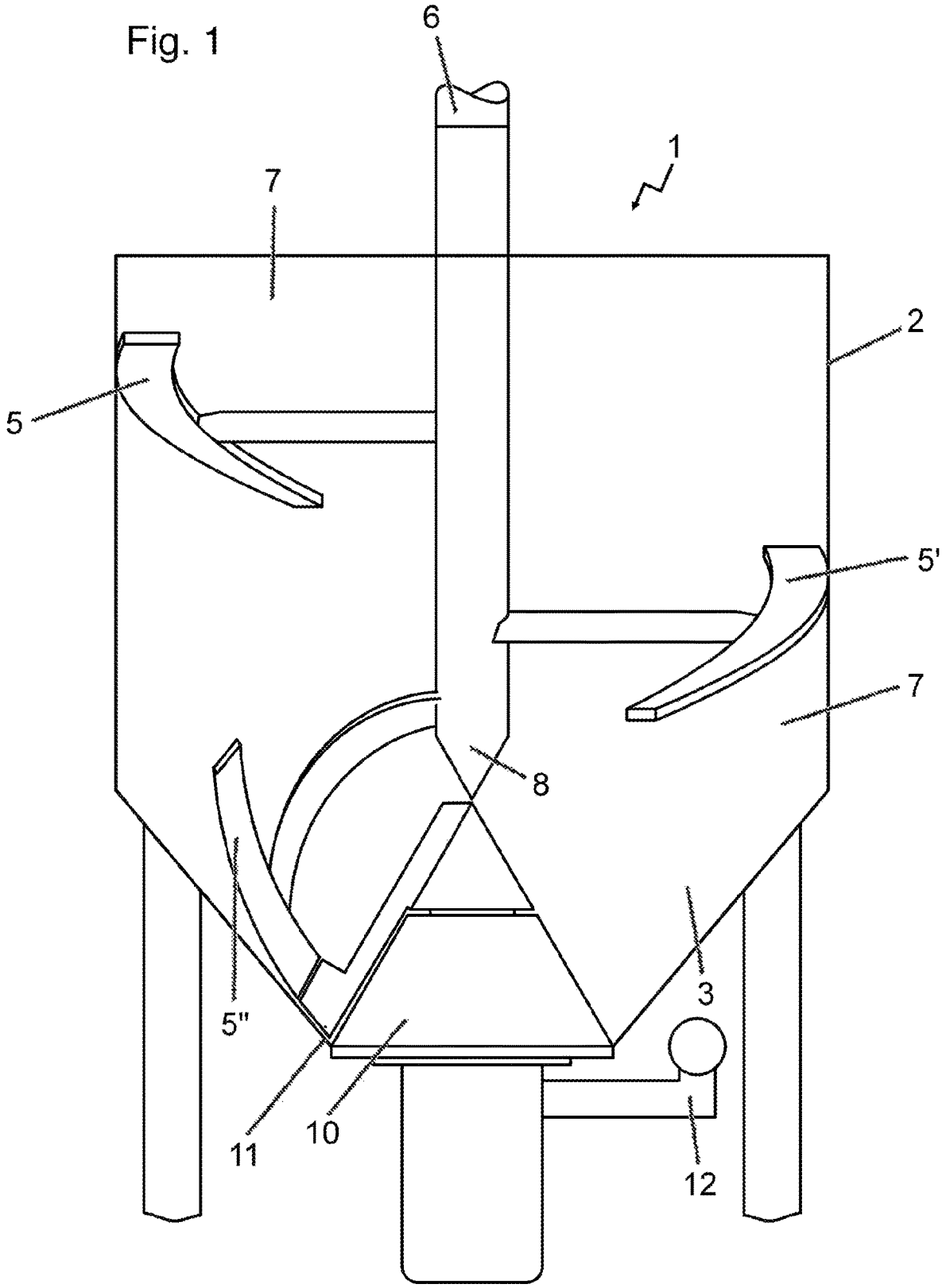

(51) Int. Cl.

| | |
|---|---|
| ***B01F 7/18*** | (2006.01) |
| ***B01F 11/00*** | (2006.01) |
| ***B01F 7/00*** | (2006.01) |
| ***B01F 15/00*** | (2006.01) |

(52) U.S. Cl.
CPC ..... *B01F 7/00408* (2013.01); *B01F 7/00541* (2013.01); *B01F 7/161* (2013.01); *B01F 7/162* (2013.01); *B01F 7/166* (2013.01); *B01F 7/18* (2013.01); *B01F 11/008* (2013.01); *B01F 15/00538* (2013.01); *B01F 15/00779* (2013.01); *B01F 15/00785* (2013.01); *B01F 15/00805* (2013.01); *B01F 15/0254* (2013.01); *B01F 15/0267* (2013.01); *B01F 15/0293* (2013.01)

(58) Field of Classification Search
CPC ..... B01F 15/00805; B01F 15/00779; B01F 7/00158; B01F 7/18; B01F 15/00785; B01F 7/162; B01F 7/161; B01F 7/00541; B01F 7/00208; B01F 11/008; B01F 15/0267; B01F 15/0292; B01F 15/0293
USPC ..... 366/192, 194–196, 108–116
See application file for complete search history.

(56) References Cited

U.S. PATENT DOCUMENTS 1,530,020 A * 3/1925 Tiedke ..... A21C 1/1485 366/192
2,087,917 A * 7/1937 Loomis ..... B01F 15/00805 366/194
2,395,571 A * 2/1946 McMilian ..... B28C 5/2081 193/10
2,464,588 A * 3/1949 Knudsen ..... B01F 7/00466 241/146
2,761,769 A * 9/1956 Elder ..... B01J 8/382 208/157
2,851,257 A * 9/1958 Morgan ..... B01F 7/245 366/195
2,949,275 A * 8/1960 Pro ..... B01F 15/00785 137/613
2,994,100 A * 8/1961 Comes ..... B29B 7/263 110/176
3,097,828 A * 7/1963 Grun ..... B01F 13/0261 222/195
3,227,425 A * 1/1966 Stanier ..... A47J 27/14 251/339
3,395,834 A * 8/1968 Troy ..... B01F 15/00201 222/504
3,490,655 A * 1/1970 Ledgett ..... B01F 5/243 222/196
3,567,402 A * 3/1971 Christensen ..... B01F 15/066 165/108
3,635,147 A * 1/1972 Lee ..... A47J 27/14 366/147
3,899,159 A 8/1975 Nauta
4,075,713 A * 2/1978 Easton ..... B01F 7/00025 366/192
4,096,968 A * 6/1978 Treiber ..... B01J 3/03 220/244
4,323,312 A * 4/1982 Glatt ..... B01J 2/16 34/364
4,516,859 A * 5/1985 Spengler ..... B65D 90/623 220/244
4,560,283 A * 12/1985 Eirich ..... B01F 15/00779 220/211
4,588,366 A * 5/1986 Glatt ..... B01J 2/16 241/5
4,621,747 A * 11/1986 van der Velde ..... A01J 25/12 137/99
4,758,095 A * 7/1988 Kanda ..... B01F 11/00 222/200
4,854,715 A * 8/1989 Eirich ..... B01F 9/12 366/139
4,878,758 A * 11/1989 Schafer ..... B01F 13/0294 366/101
4,915,506 A * 4/1990 Sato ..... F26B 11/12 366/146
5,063,840 A * 11/1991 Vote ..... B30B 9/20 100/121
5,232,281 A * 8/1993 Campbell ..... B01F 15/00779 366/144
5,249,861 A * 10/1993 Thomson ..... A01J 25/02 366/194
5,409,149 A * 4/1995 Hough ..... B01F 15/00785 105/286
5,462,254 A * 10/1995 Muller ..... B65D 90/626 251/144
5,492,403 A * 2/1996 Metcalf ..... B29B 7/263 366/195
5,630,666 A * 5/1997 Rodriguez ..... B01F 7/1695 222/185.1
5,810,475 A * 9/1998 St. Ama ..... B65D 90/587 222/556
5,893,567 A 4/1999 Bitterli
6,578,743 B1 * 6/2003 Kokeisl ..... B65D 88/68 222/342
6,652,133 B2 * 11/2003 Ghanizadeh Khoub ..... A21C 1/02 366/188
6,669,360 B1 * 12/2003 Adelmann ..... B65D 90/623 366/192
6,800,354 B2 * 10/2004 Baumann ..... B08B 17/06 428/141
7,841,763 B2 * 11/2010 Foster ..... A61B 17/8802 366/139
8,911,139 B2 * 12/2014 Naoi ..... B29B 7/183 366/142
8,944,674 B2 * 2/2015 Kim ..... B01F 5/104 366/195
2001/0020657 A1 * 9/2001 Gloor ..... B01F 7/1605
2006/0233043 A1 * 10/2006 Himmelsbach ..... B08B 17/06 366/147
2016/0354743 A1 * 12/2016 Veit ..... B01F 7/00158

FOREIGN PATENT DOCUMENTS

DE 195 46 848 A1 6/1997
DE 198 09 476 A1 9/1999
DE 199 26 045 A1 12/2000
GB 1019951 A * 2/1966 ..... A23G 3/0215
GB 1 195 850 A 6/1970
GB 2 134 220 A 8/1984
JP S 55-76029 U 5/1980
JP S 59-4426 A 1/1984
JP 10286820 A * 10/1998 ..... B01F 15/00032
JP 2006-043624 2/2006

* cited by examiner

APPARATUS FOR ACCOMMODATION AND DISPENSING OF MISCIBLE MATERIALS HAVING DISCHARGE OPENING PROVIDED WITH A DISPLACER APPARATUS

CROSS REFERENCE TO RELATED APPLICATIONS

This application is the National Stage of PCT/EP2015/053333 filed on Feb. 17, 2015, which claims priority under 35 U.S.C. § 119 of European Application No. 14167217.0 filed on May 6, 2014, the disclosures of which are incorporated by reference. The international application under PCT article 21(2) was not published in English.

The invention relates to an apparatus for accommodation and dispensing of miscible materials, having a cylindrical accommodation vessel having a lower region in the form of a truncated cone, which has a lower discharge opening in the direction of gravity, and having a mixing mechanism shaft disposed centrally in a mixing space, which shaft has at least one mixing mechanism that revolves in the accommodation vessel.

In the state of the art, mixing machines having mixing spaces with rotation symmetry are already known, in which machines the drive shaft of the mixing tools is mounted in the center of the mixing space. A mixer drive having a mixing mechanism shaft with at least one mixing tool is situated in an essentially horizontal pivot axis, wherein the mixing tool is a helical spiral wound around the mixing mechanism shaft in the manner of a helix. According to DE 199 26 045 C2, the mixed material container is a container that narrows in cross-section toward the lower end, with a bottom-side closure for the mixing mechanism. The mechanism dips into the mixed material container when the container is closed. According to DE 198 09 476, the helical spiral is screwed in as it dips into the mixed material. The container according to DE 199 26 045 C2 is self-emptying on the basis of its shaping and the bottom-side closure; mass flow takes place free of de-mixing, in simple manner, quickly, and completely.

The mixing tool is supposed to run through the mixed materials as completely as possible. However, in the case of the apparatuses known in the state of the art, only rotational movement is present in the center of the mixing space. In contrast, rotation and the related translation takes place in the periphery. This also holds true for the mixed materials taken hold of by the mixing tool. They are mixed all the more intensively, the farther they are removed from the axis of rotation of the mixing tool.

A helical-spiral mixing tool generates three-dimensional total flow conditions. In this regard, the upward flow takes place in the periphery, while the downward flow takes place in the center. In order to achieve three-dimensional shifting of the mixed goods, additional mixing mechanisms or complicated mountings are required.

For example, JP 2006 043624 A shows an apparatus for accommodation and dispensing of miscible materials, having a screw that circulates orbitally in the mixing space. A discharge opening is provided in the bottom region of the accommodation vessel, which opening is provided with a bottom lid that is domed upward.

An apparatus for accommodation and dispensing of miscible materials is known from JP S55 76029 U, having a main mixing mechanism disposed centrally in the mixing space and having a spiral-shaped stirring vane, which is disposed along a vessel wall, wherein the discharge opening has a bottom plate that is domed upward.

It is therefore the task of the invention to create a simple solution in which all the mixed materials situated in the mixing space reliably flow through both the zones of slight mixing and the zones of intensive mixing.

This task is accomplished, according to the invention, in that the discharge opening is provided with a displacer apparatus that projects into the interior of the lower region of the accommodation vessel, and that a main mixing tool of the mixing mechanism projects into the approximately V-shaped channel between a lower vessel wall and the displacer apparatus. A displacer apparatus is understood to be not only a dynamic element but also a static element.

In this way, it is ensured that all of the particles involved in a formulation come into relative motion with regard to the adjacent particles, in each instance. The displacer apparatus guides the mixed materials from the center of the mixing space into its periphery. There, they are taken up by the main mixing tool, i.e. by the lower end of the mixing screw or mixing spiral of the mixing mechanism, which projects into the channel that is between lower vessel wall and the displacer apparatus and that is approximately V-shaped in cross-section, and conveyed upward. As a result, perfect flow conditions of the mixed material take place even in the conical bottom region of the mixing space, in more space-controlling and effective manner. At the same time, low-wear mixing is possible, the mixing space can be. cleaned perfectly after being emptied and, at the same time, it forms a mixing container as well as a reactor container.

In this way, it is possible to mix even components having different flow suitability values, densities, degrees of moisture, and particle sizes with one another in reliable and uniform manner. At the same time, the apparatus can optionally be operated as a batch mixer or a continuous mixer.

At the same time, the known problems of upright-standing mixers having a vertically mounted mixing mechanism shaft are solved. Usually, the mixed materials lie all the more heavily one on top of the other; the dynamic pressure in the lower mixer region increases in proportion to how large the mixer is configured to be. In such a case, the mixed materials can easily become compacted and form clumps. The mixing tool then has to overcome the increased dynamic pressure. The mixing process is made more difficult because loosening effects are absent. This happens particularly frequently if the bottom of the vertical mixer has a cone or truncated cone. The materials situated in the lower mixer region, which narrows conically, can practically not be loosened because of the circulating circumference speed of the mixing tool, and therefore they cannot flow freely. For this reason, the materials situated here move almost only in a circle. Until now, attempts were made to optimize the spiral shape of the mixing tool and to increase the speed of rotation. However, this is only possible to a limited extent in the case of large mixers. In every case, the mixing time must be drastically lengthened. In some cases, part of the mixed material is actually removed from the mixing vessel at the bottom, during mixing, and put back into the mixing space from above.

All of these difficulties are eliminated by the new solution according to the invention, in which the mixed material is guided from, the center into the periphery by the displacer apparatus that projects into the lower region of the accommodation vessel, where the material is taken up by the lower end of the mixing screw or mixing spiral of the mixing mechanism, which end projects into the channel between lower vessel wall and displacer apparatus, which channel is approximately V-shaped in cross-section, and conveyed upward by the helical spiral that is wound around the mixing mechanism shaft in helix shape, with the corresponding translation movement, before it trickles down or flows down again from there along the mixing mechanism shaft in the center of the mixing mechanism.

It is advantageous if the displacer apparatus can be pushed into the interior of the accommodation vessel to open the discharge opening, and, for this purpose, it is advantageous if it is disposed within the mixing space. In this regard, the displacer apparatus is suitable for dipping into the mixing space, in order to empty the vessel, which is open at the bottom, and the mixer, without colliding with the mixing tool and without impairing the mixing efficiency.

Alternatively, the displacer apparatus can also be lowered below the discharge opening to open the discharge opening, also without colliding with the mixing tool and without influencing the mixing efficiency.

It is practical if the displacer apparatus has a greater diameter at its lower edge than the discharge opening of the mixing vessel, if it is disposed within the mixing space and can be pushed into the interior of the accommodation vessel to open the discharge opening. In this way, tight and secure closure of the emptying opening is ensured. The same holds true if the displacer apparatus can be lowered below the discharge opening to open the discharge opening. In this regard, the displacer apparatus can be moved translationally into the mixing space or can be lowered out of it. Alternatively, it can be moved into the lower region of the accommodation vessel or lowered out of it by means of a lifting/rotating movement.

In every case, it is provided that the displacer apparatus ends with the lower vessel wall, in sealed manner. The displacer apparatus can be formed to be conical, hyperbola-like, parabola-like, scale-like, dome-like, roof-like, hemispherical, trumpet-shaped, droplet-shaped, in the form of a truncated cone, convex or concave. Likewise, a static, smooth or dome-like configuration is possible. The displacer apparatus can be structured as a component fixed in place. It can also be driven and mounted on the underside, and can be designed in both high-speed and low-speed manner. The displacer apparatus can be configured to be convex or concave. It can furthermore be translationally moved into the mixing space or lowered out of it. Furthermore, the displacer apparatus can be structured as an opening.

Further embodiments are evident from the dependent claims. In particular, multiple, particularly two or three accommodation vessels can also overlap with one another, in such a manner that a two-shaft or three-shaft mixer, having further improved mixing properties, can be formed.

It is particularly advantageous if the displacer apparatus is formed and composed in such a manner that the miscible materials slide along it due to gravity. In this way, the miscible materials or the mixed material get from the center of the mixing space into its periphery, and thereby into the acquisition range of the mixing tools, in simple manner.

It is furthermore advantageous if the main mixing tool is shaped in such a manner that it takes up the mixed material even at the bottom of the channel that is approximately V-shaped in cross-section. In this way, acquisition without a dead space and reliable mixing of the mixed goods are achieved.

The mixed material can easily be conveyed upward along the lower vessel wall, out of the channel that is approximately V-shaped in cross-section, and effectively mixed, using a main mixing tool that is adapted to the contour of the lower vessel wall.

A significant advantage furthermore results from the fact that the main mixing tool is shaped to be contour-parallel, corresponding to the lower vessel wall. Thus, the main mixing tool is adapted to the contour of the lower vessel wall in such a manner, in this case, that a preferably uniform small gap between main mixing tool and lower vessel wall exists over the tool length. In this way, particularly effective mixing can be achieved.

It is particularly advantageous if a clearance angle is disposed between the lower vessel wall and the main mixing tool. In this way, it can be ensured that the mixed material that gets between the lower vessel wall and the formed-on main mixing tool is not stressed, in other words not subjected to further strain or loads.

It is furthermore advantageous that the displacer apparatus is stripped off by the main mixing tool in certain regions. If this region is provided in a lower region part of the displacer apparatus, and if this region part extends all the way to the bottom of the channel that is approximately V-shaped in cross-section, particularly good mixing of the mixed materials is guaranteed. Preferably, the stripped-off lower region part should maximally amount to one-third of the total height of the displacer apparatus that projects into the interior of the lower region of the accommodation vessel.

A further advantageous embodiment provides that the incline of the surface between a lower edge of the displacer apparatus and an upper end of the displacer apparatus has an angle of at most 65 degrees relative to the direction of gravity after the lifting/rotating movement. This means that the incline of the surface with which the displacer apparatus projects into the lower region of the accommodation vessel amounts to about 25 degrees or more relative to a horizontal plane that lies orthogonal to the direction of gravity, even in the open position. What is advantageous about this embodiment is that the displacer apparatus does not have to be lowered completely out of the mixing space. Thus, dispensing of the miscible materials through the discharge opening, in the direction of gravity, already takes place at slight opening angles of 15 to 30 degrees. Thus, even a slight lifting/rotating movement already suffices to open the discharge opening to such an extent that the miscible materials are dispensed through the discharge opening due to gravity. This measure therefore saves costly construction space below the discharge opening.

Figure 2:
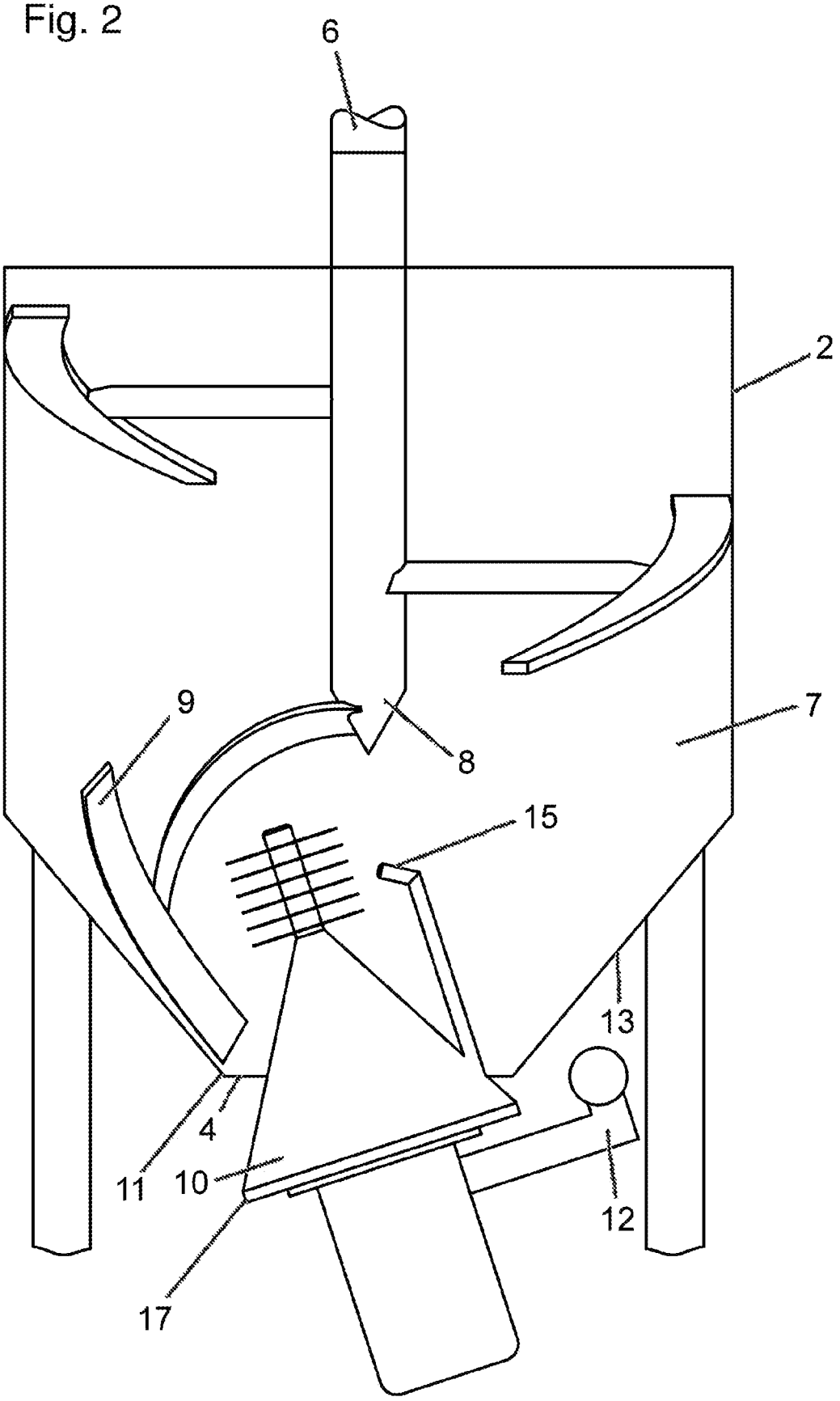
Figure 3:
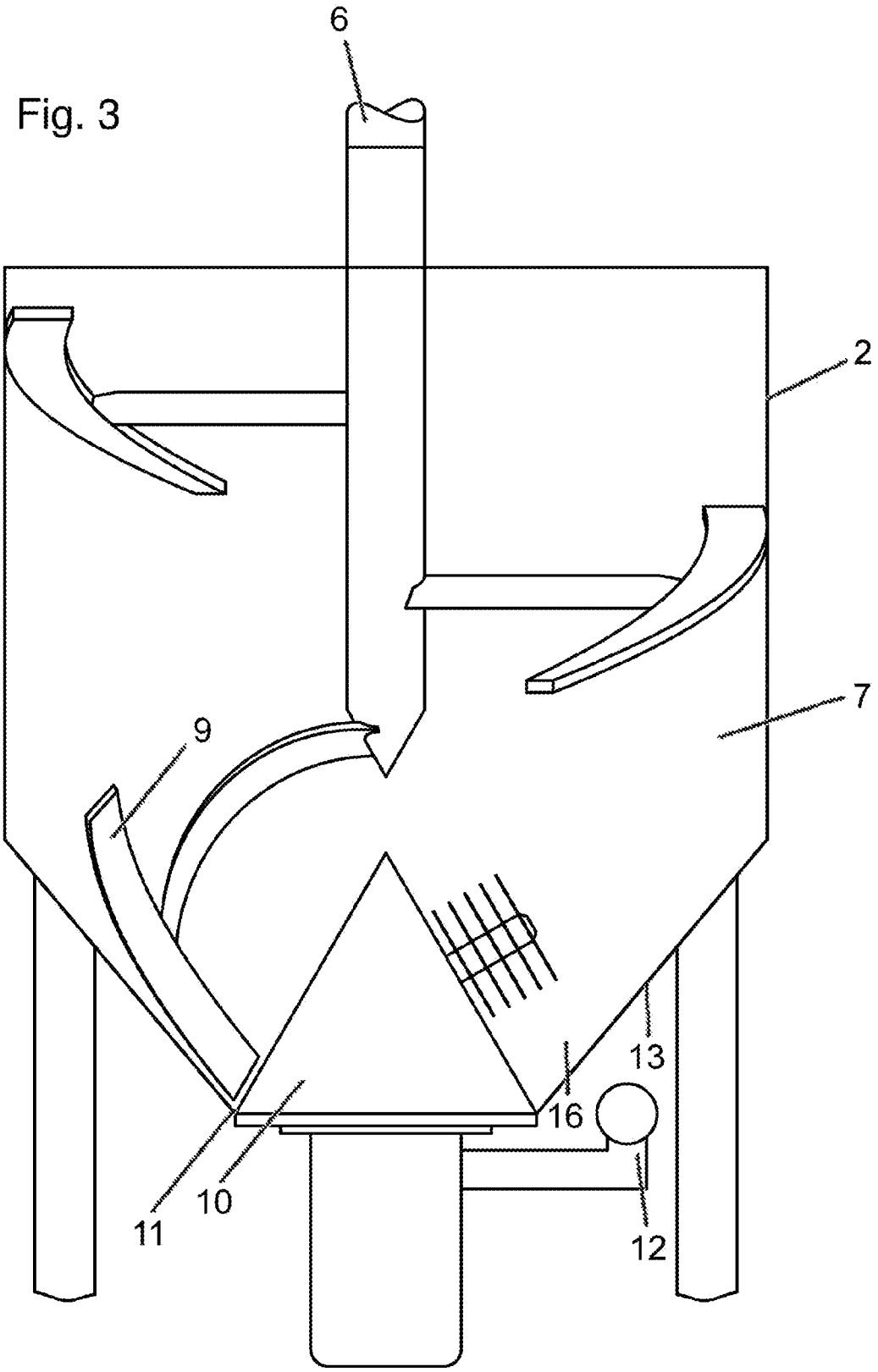
Figure 4:
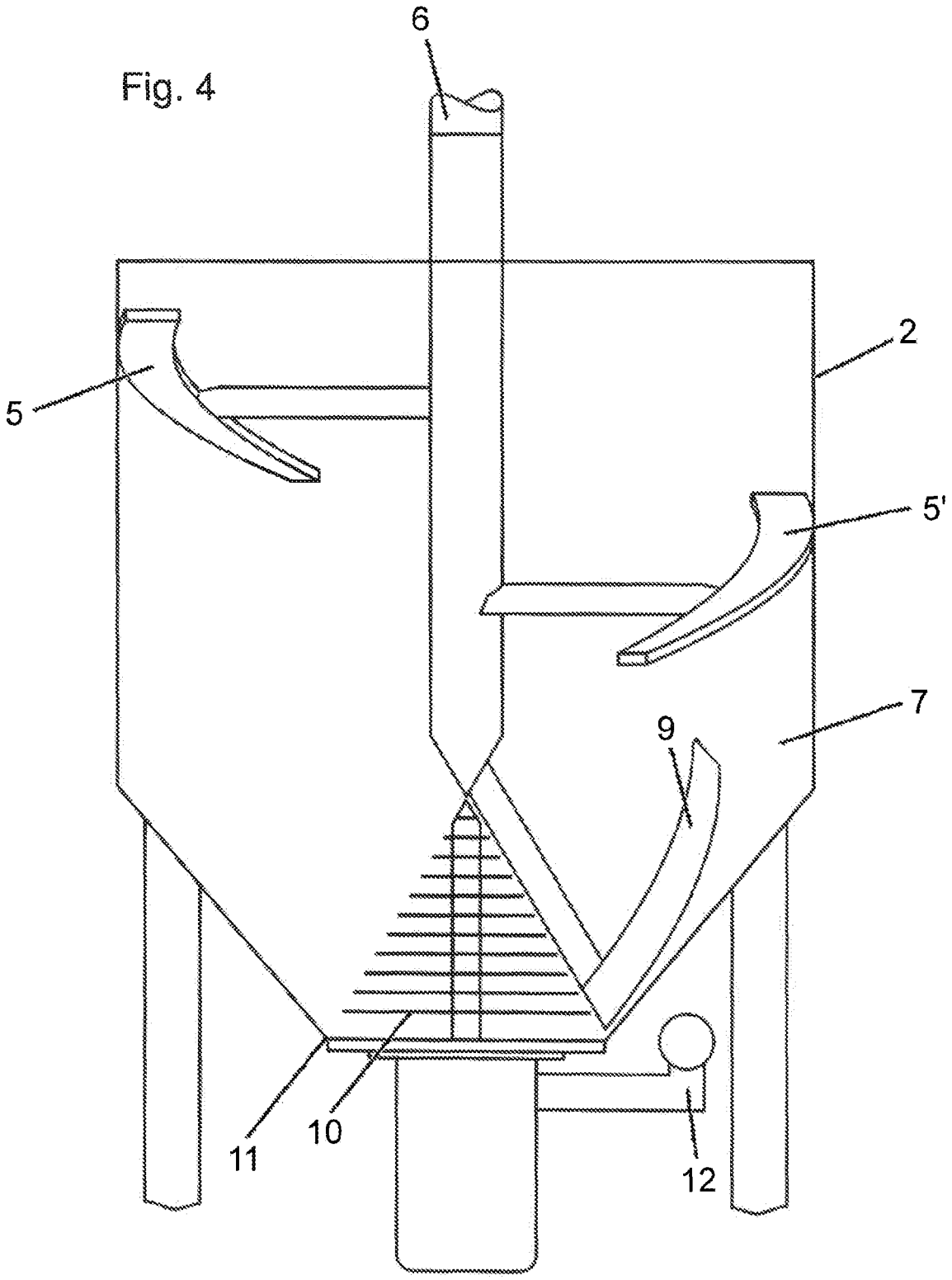
Figure 5:
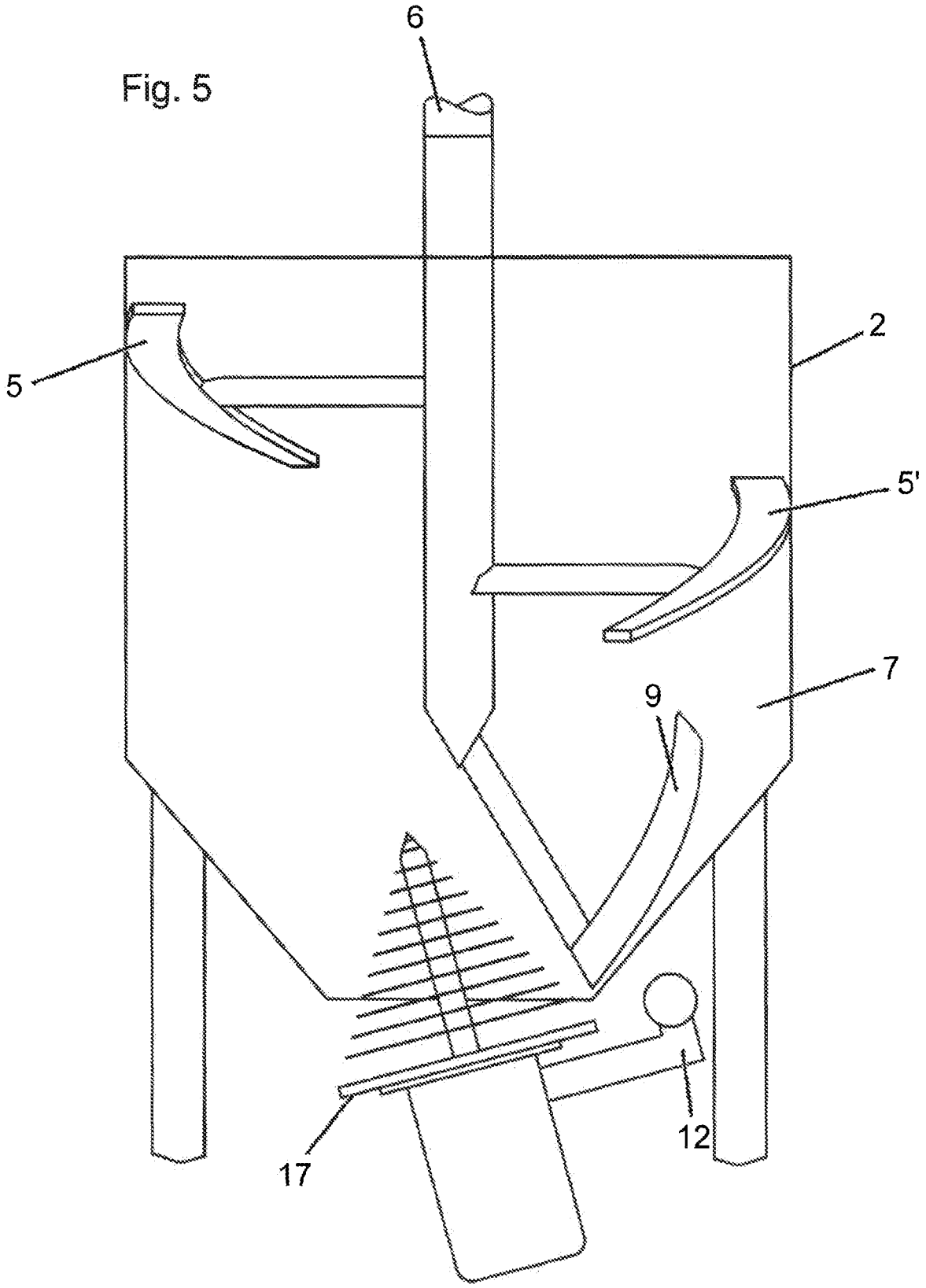
Figure 6:
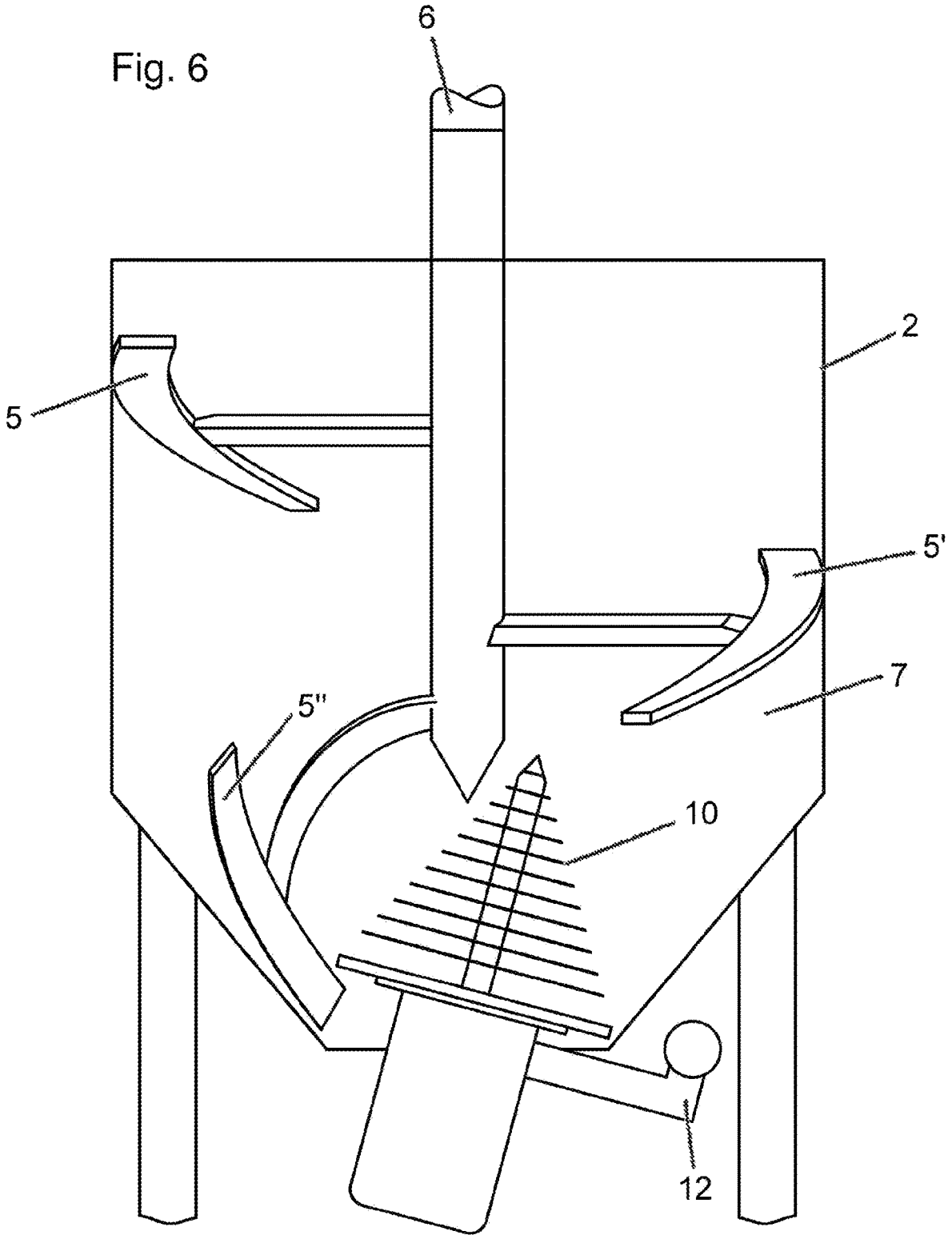
Figure 7:
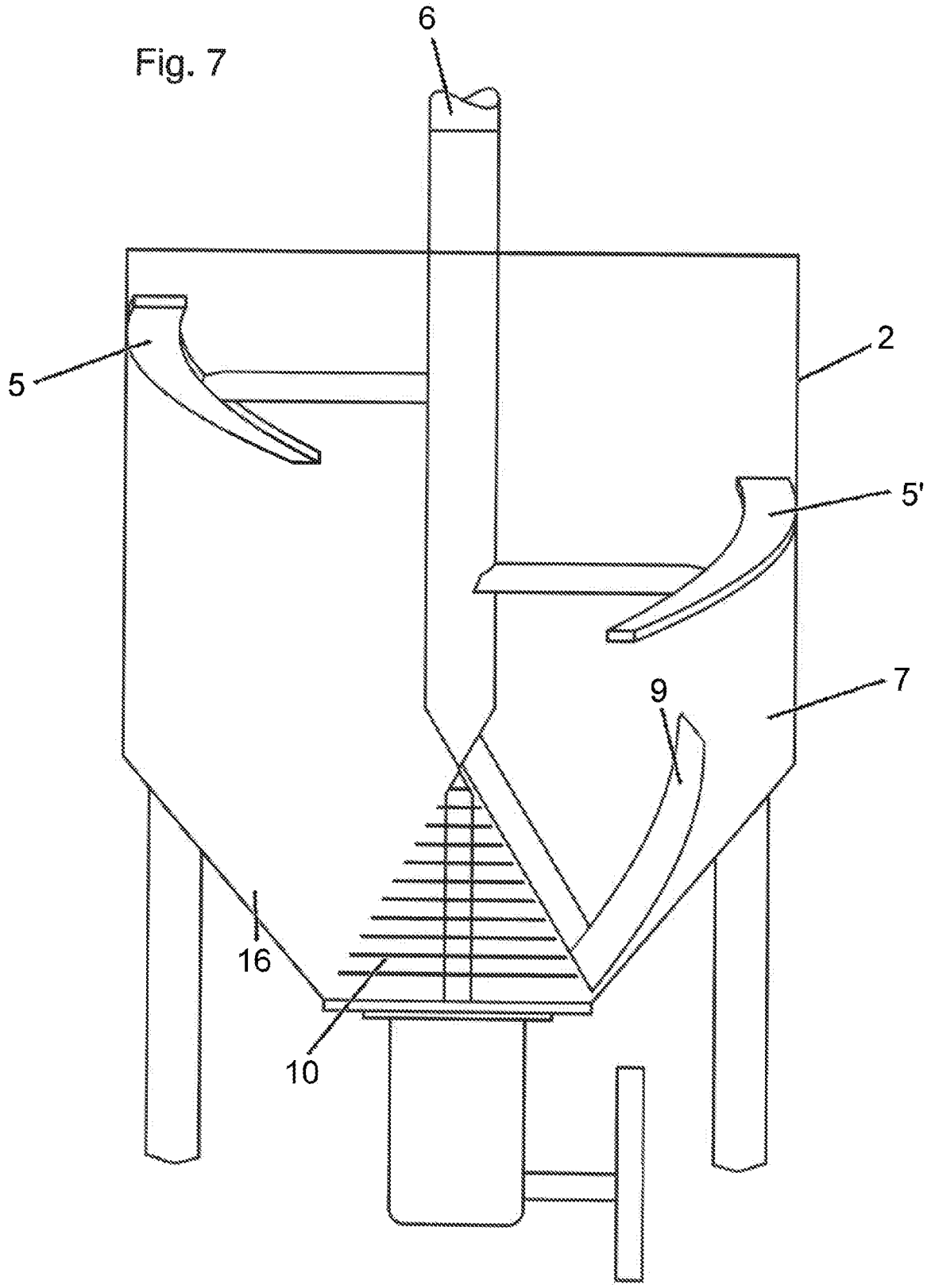
Figure 8:
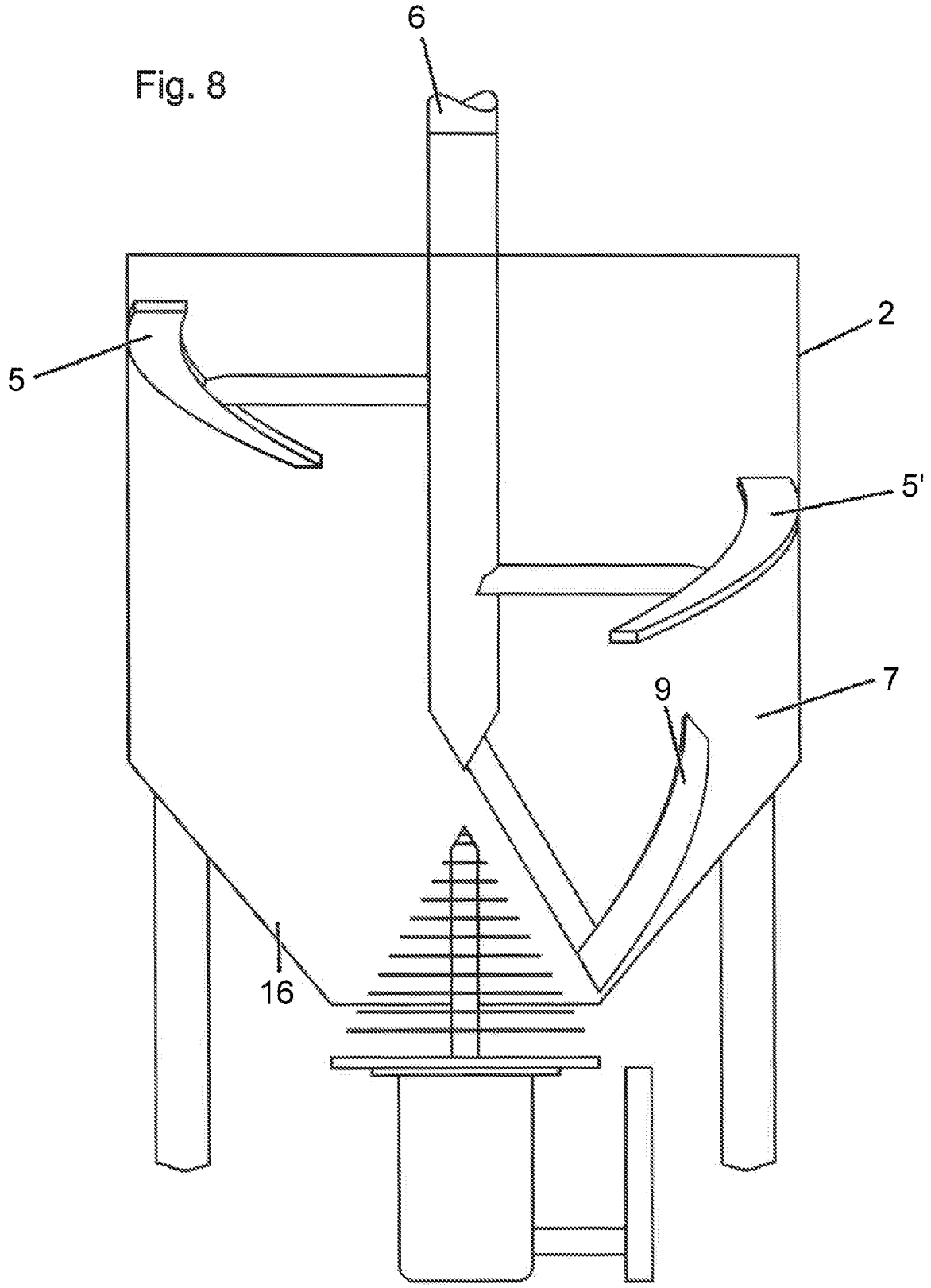
Figure 9:
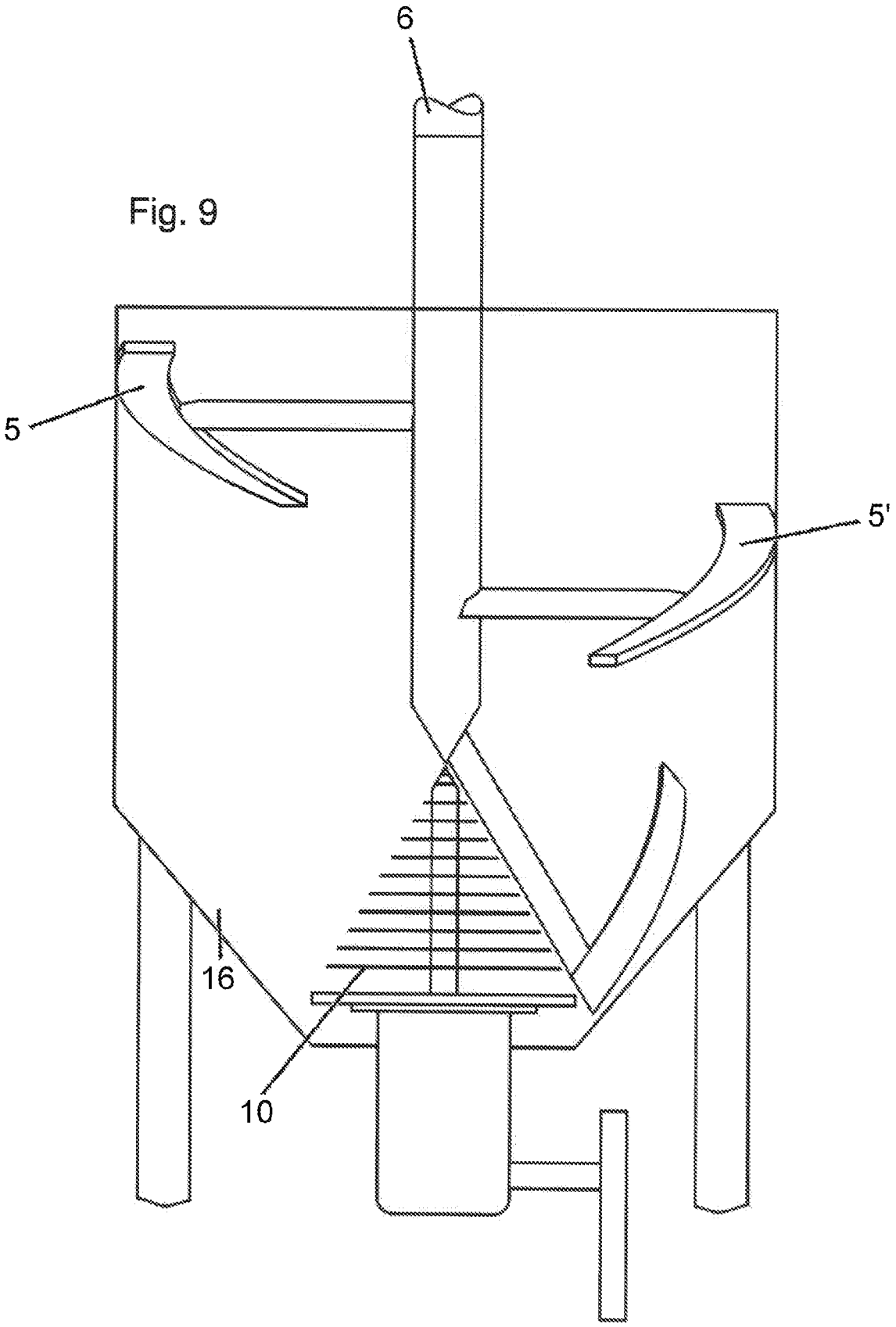
Figure 10:
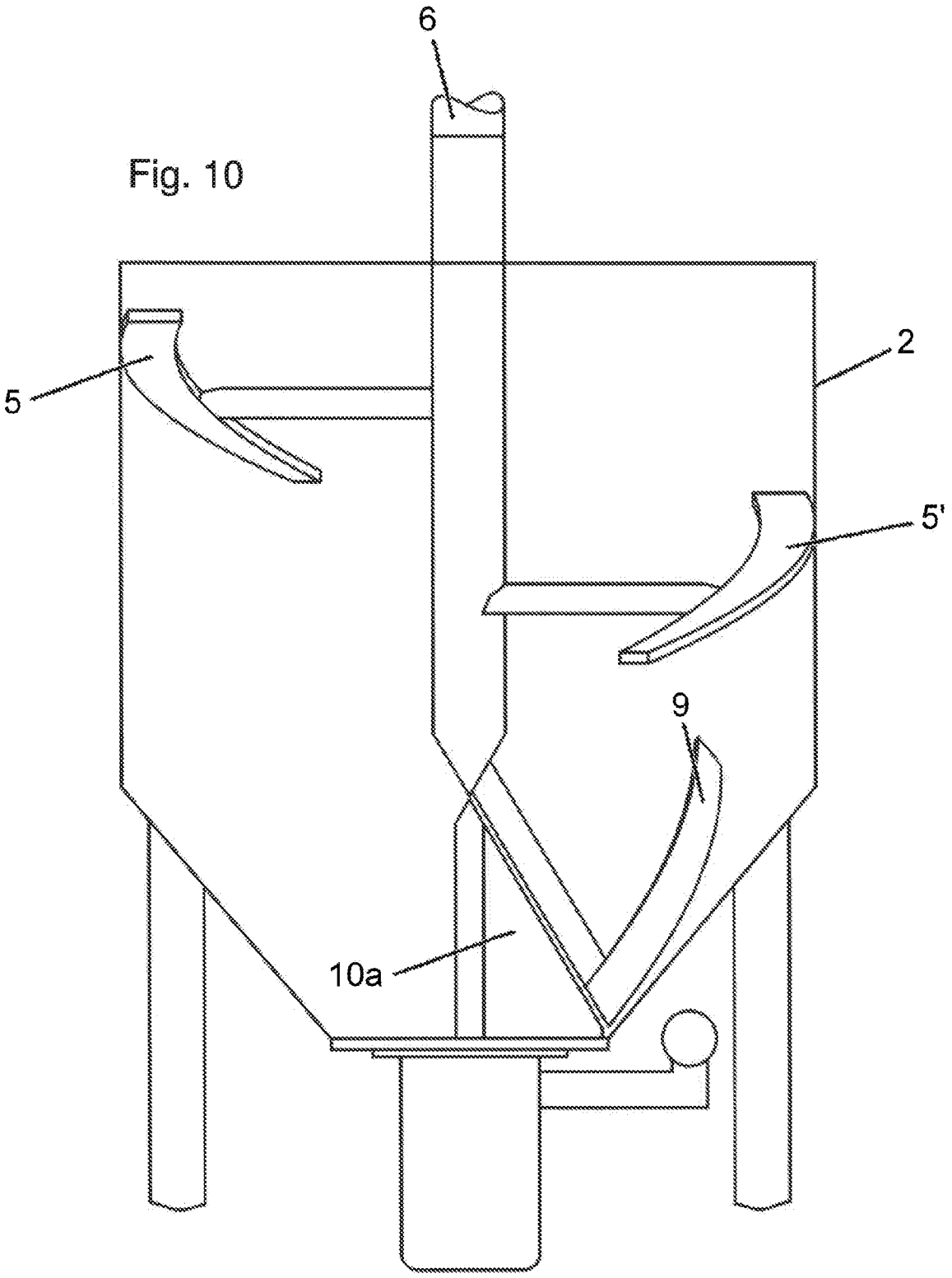
Figure 11:
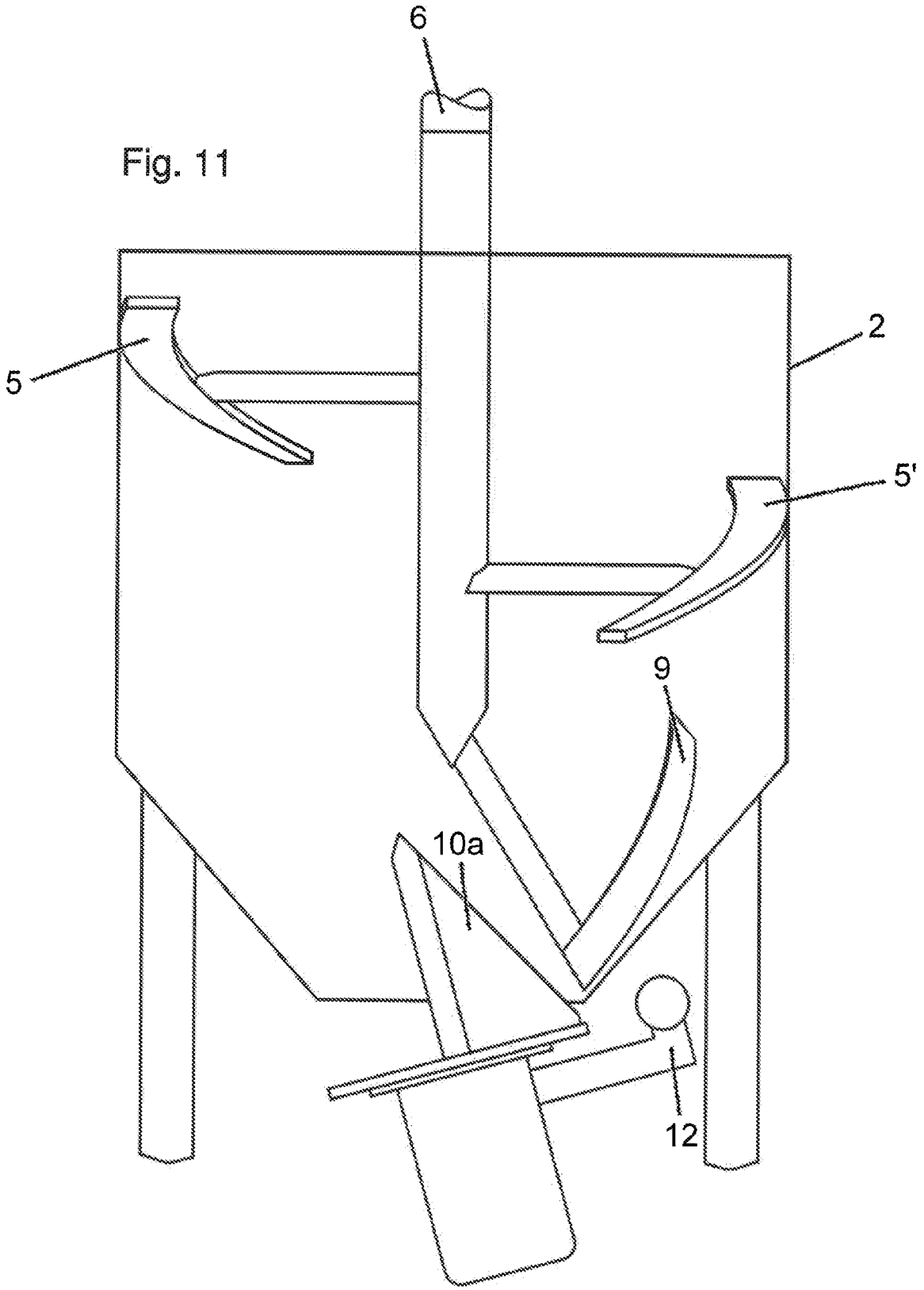
Figure 12:
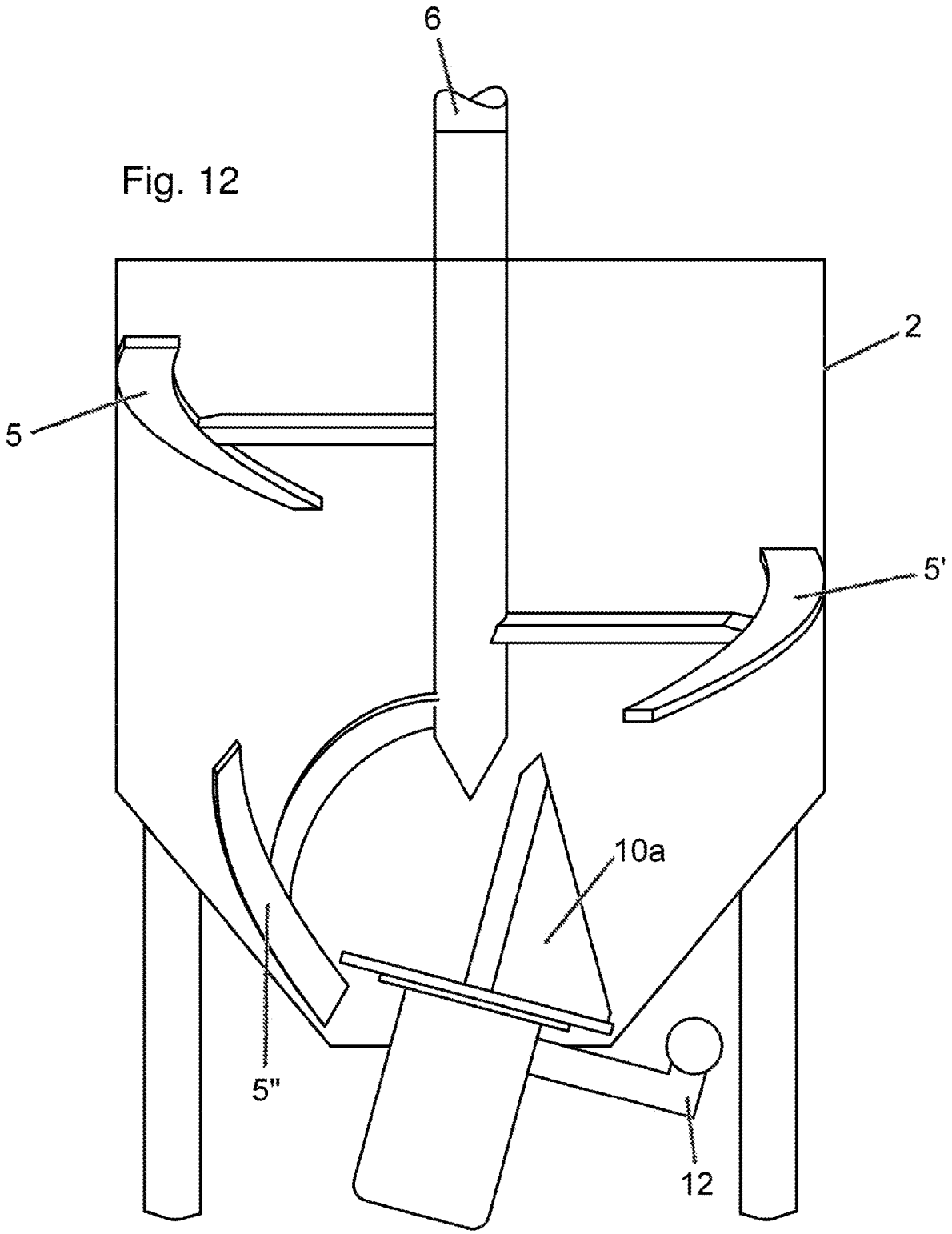
Figure 13:
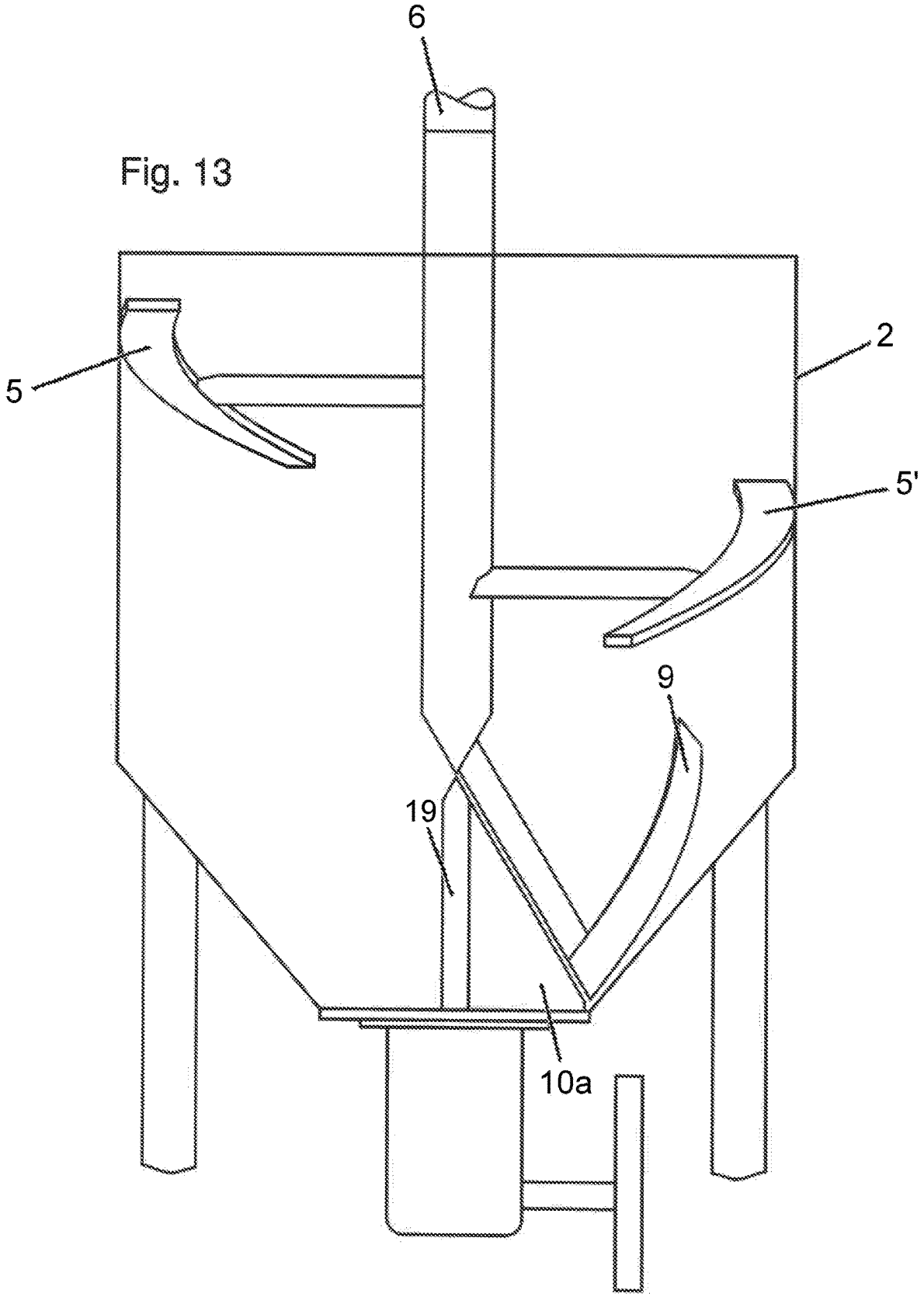
Figure 14:
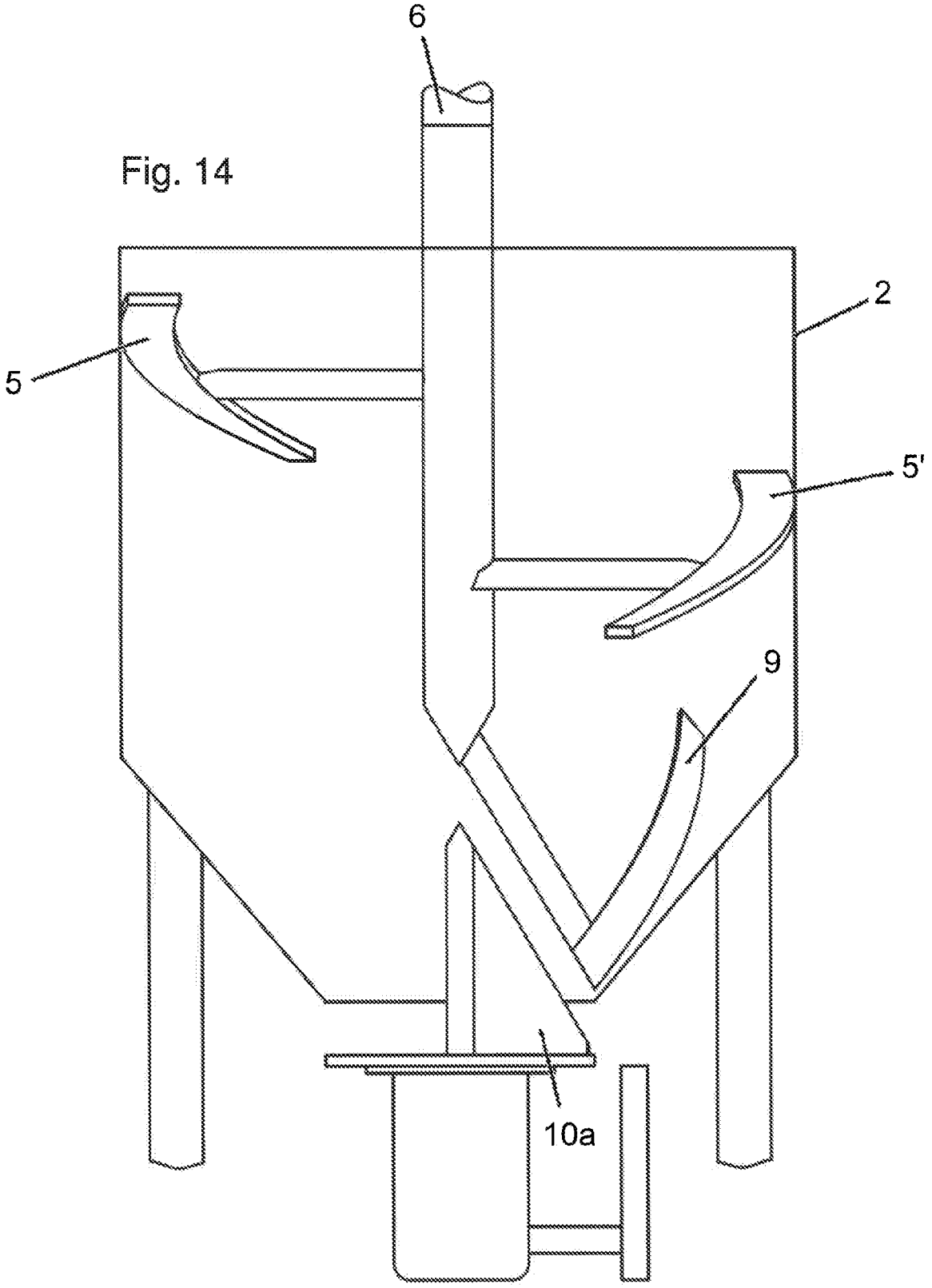
Figure 15:
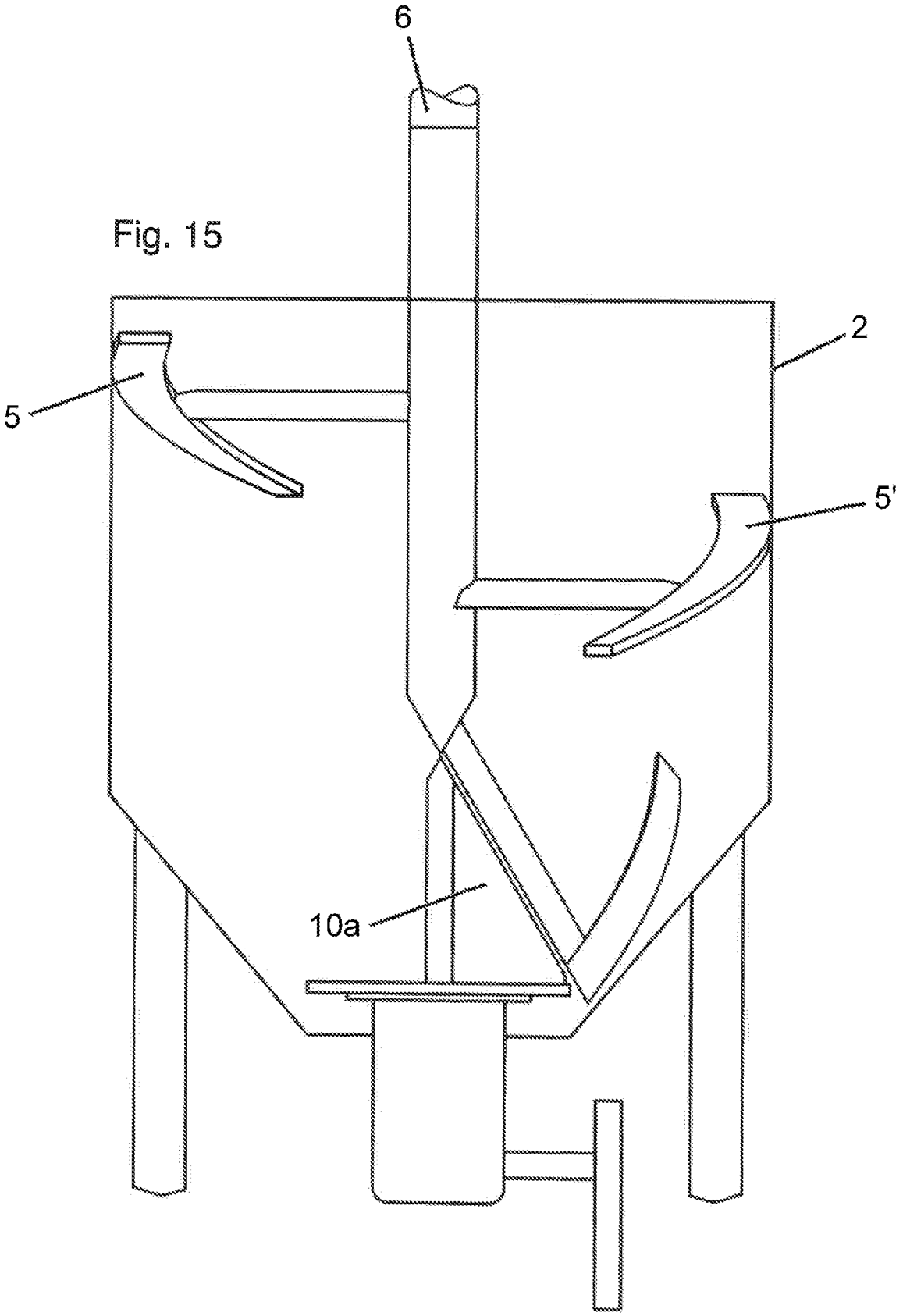
Figure 16:
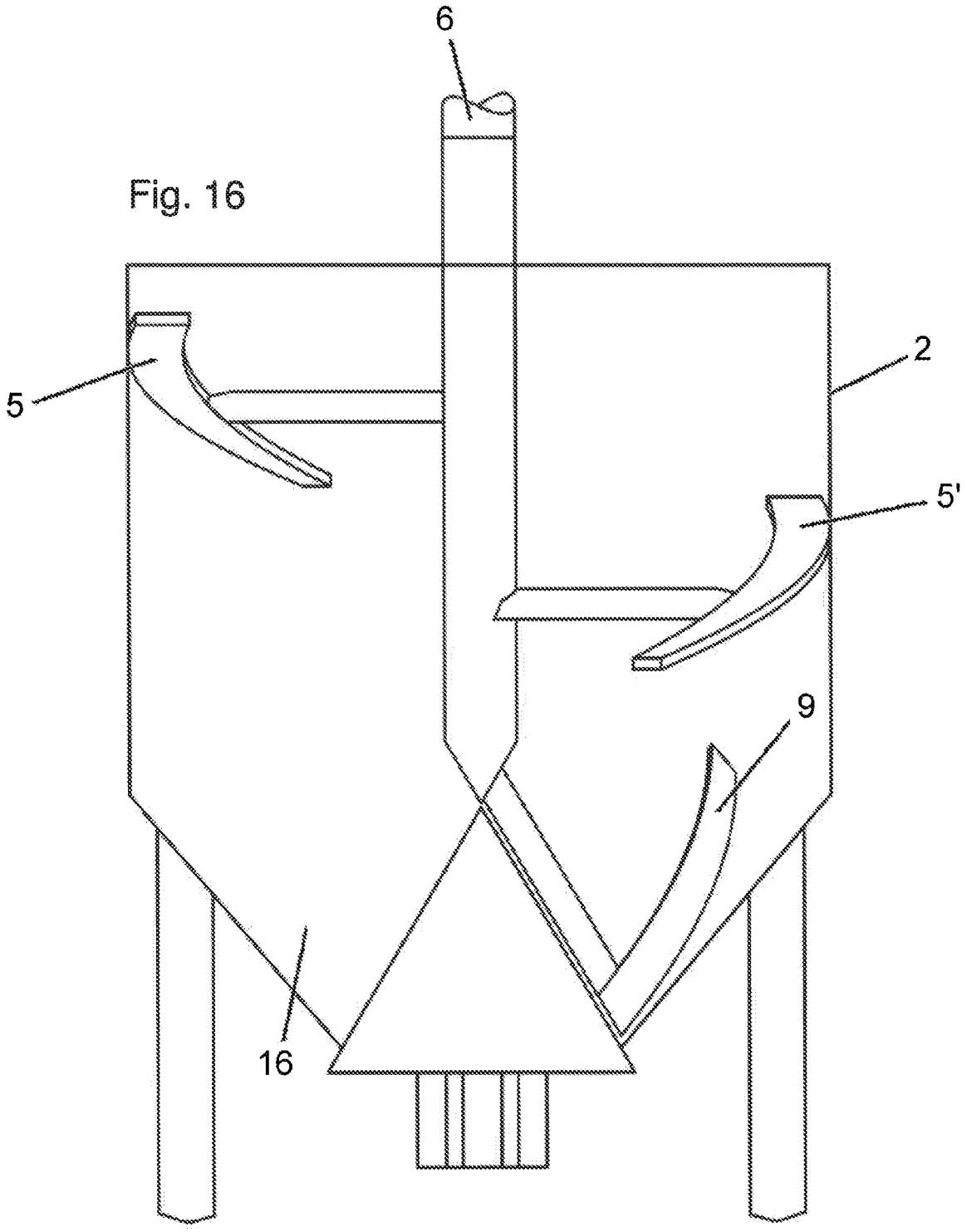
Figure 17:
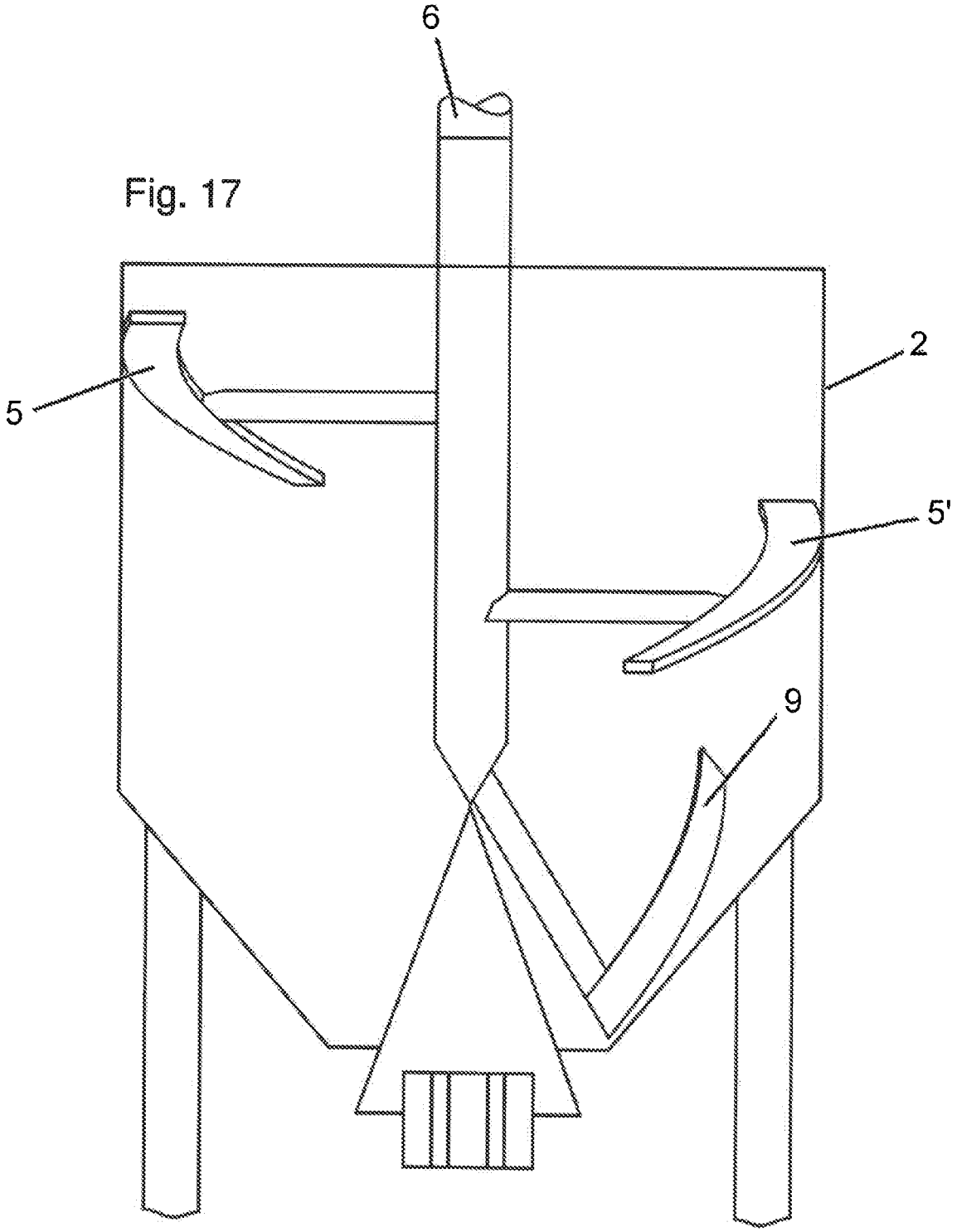
Figure 18:
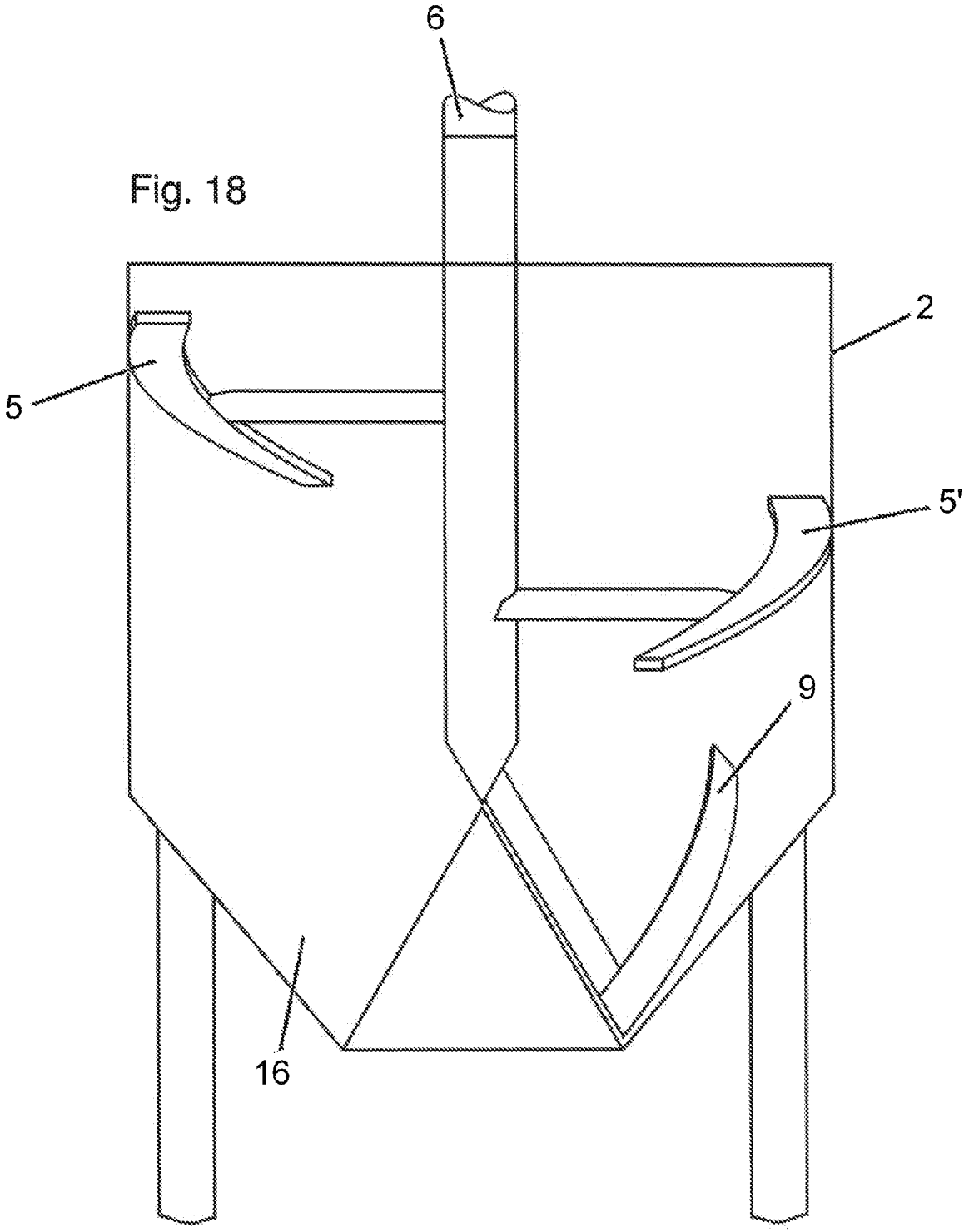
Figure 19:
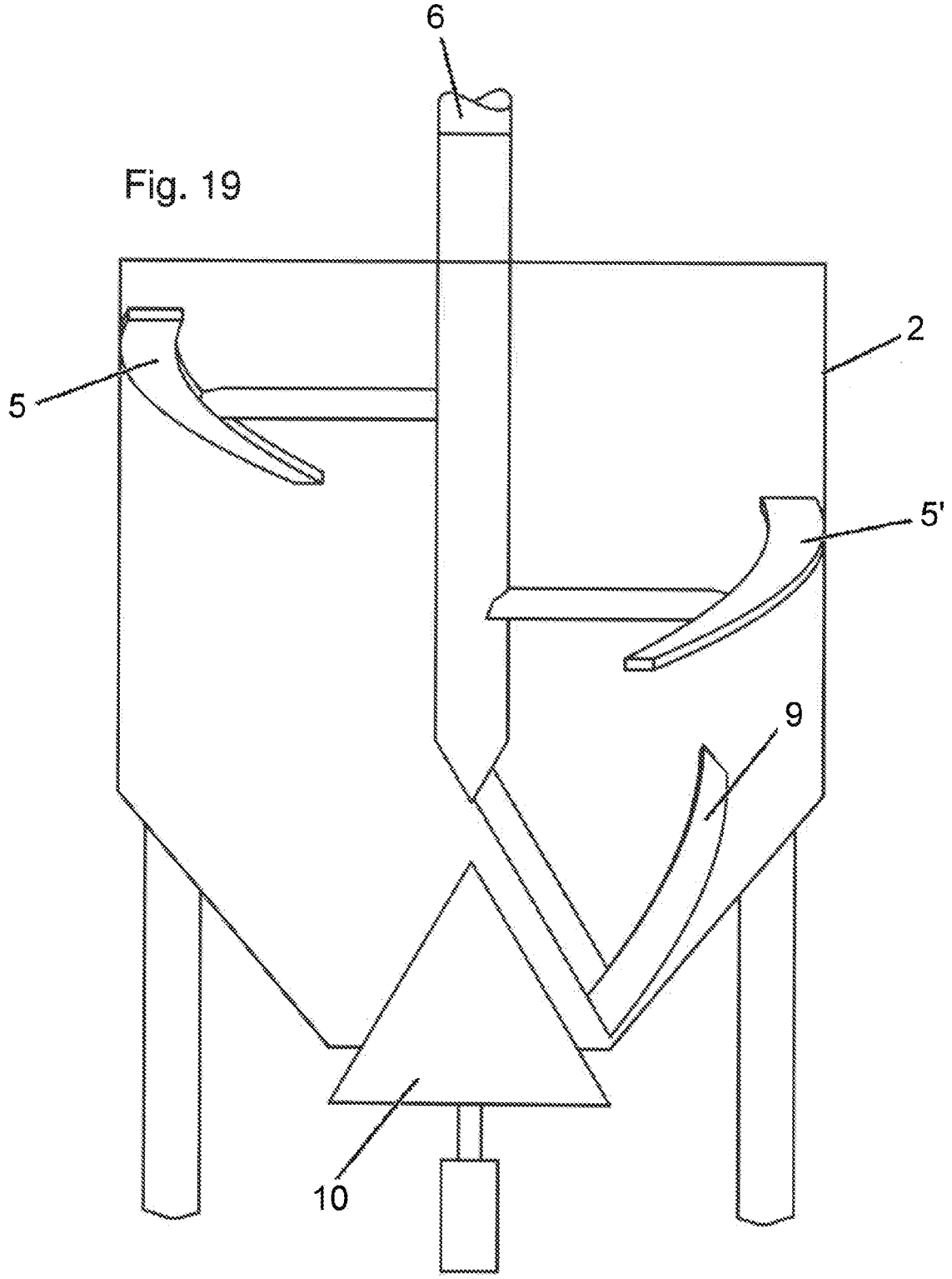
Figure 20:
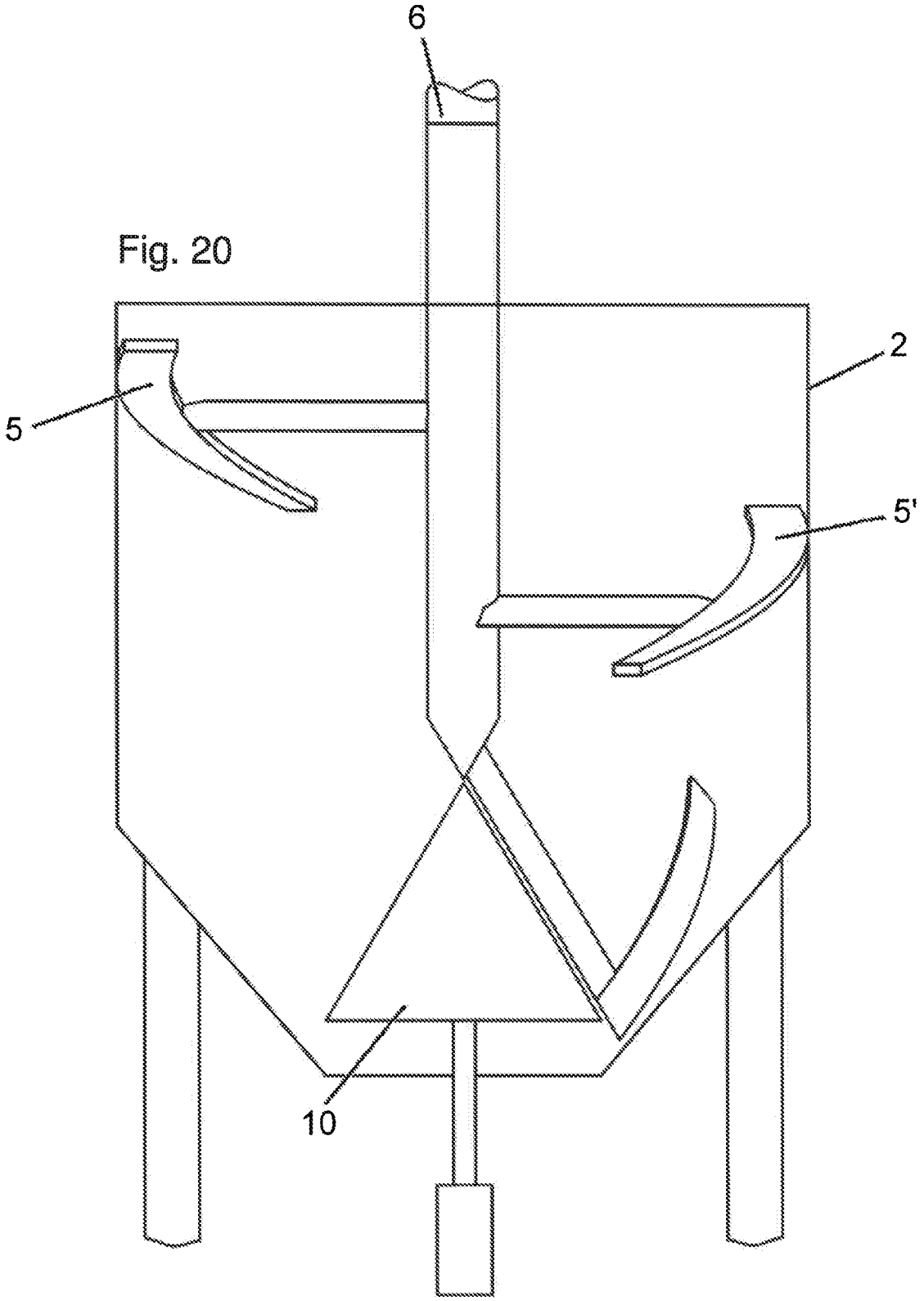
Figure 21:
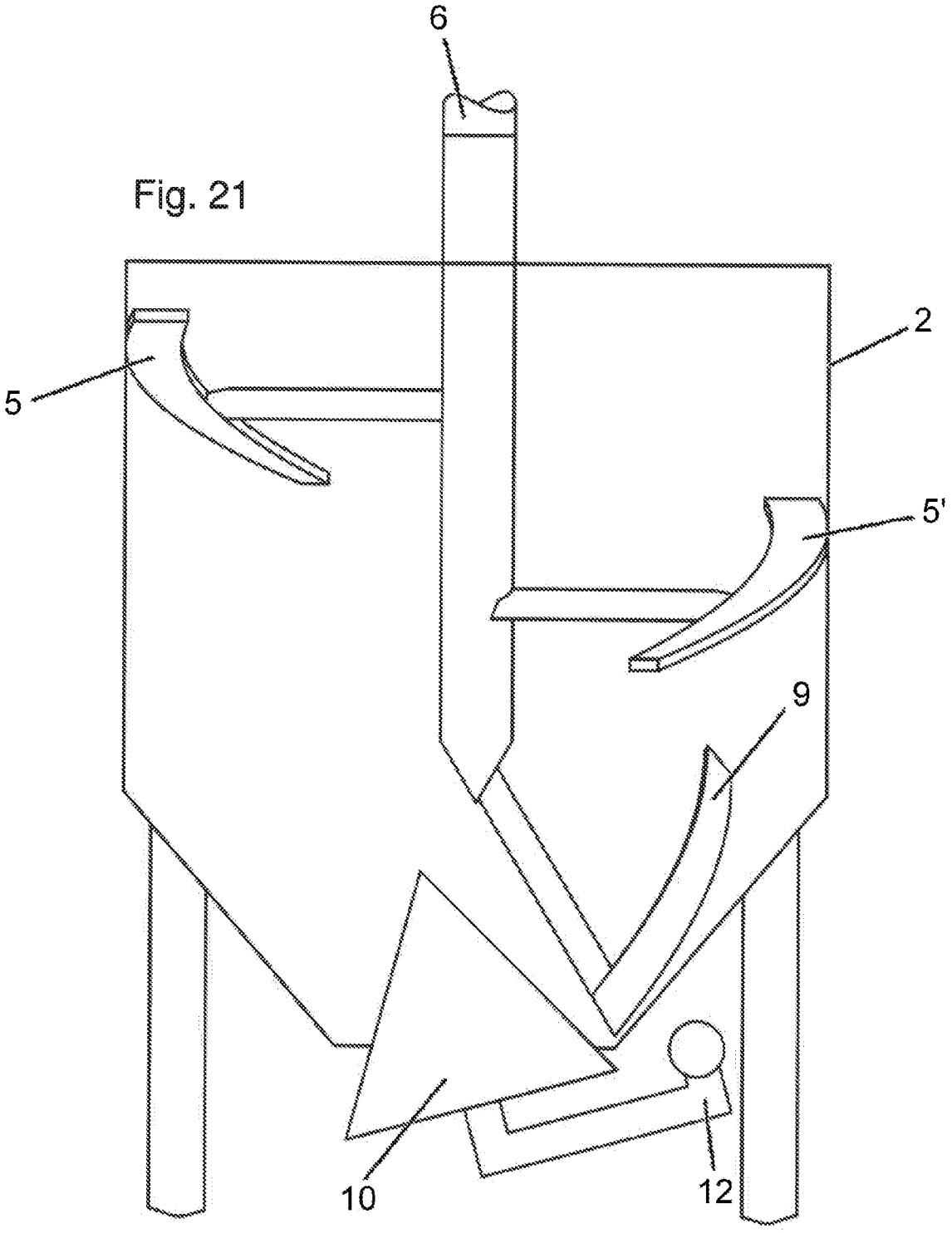
Figure 22:
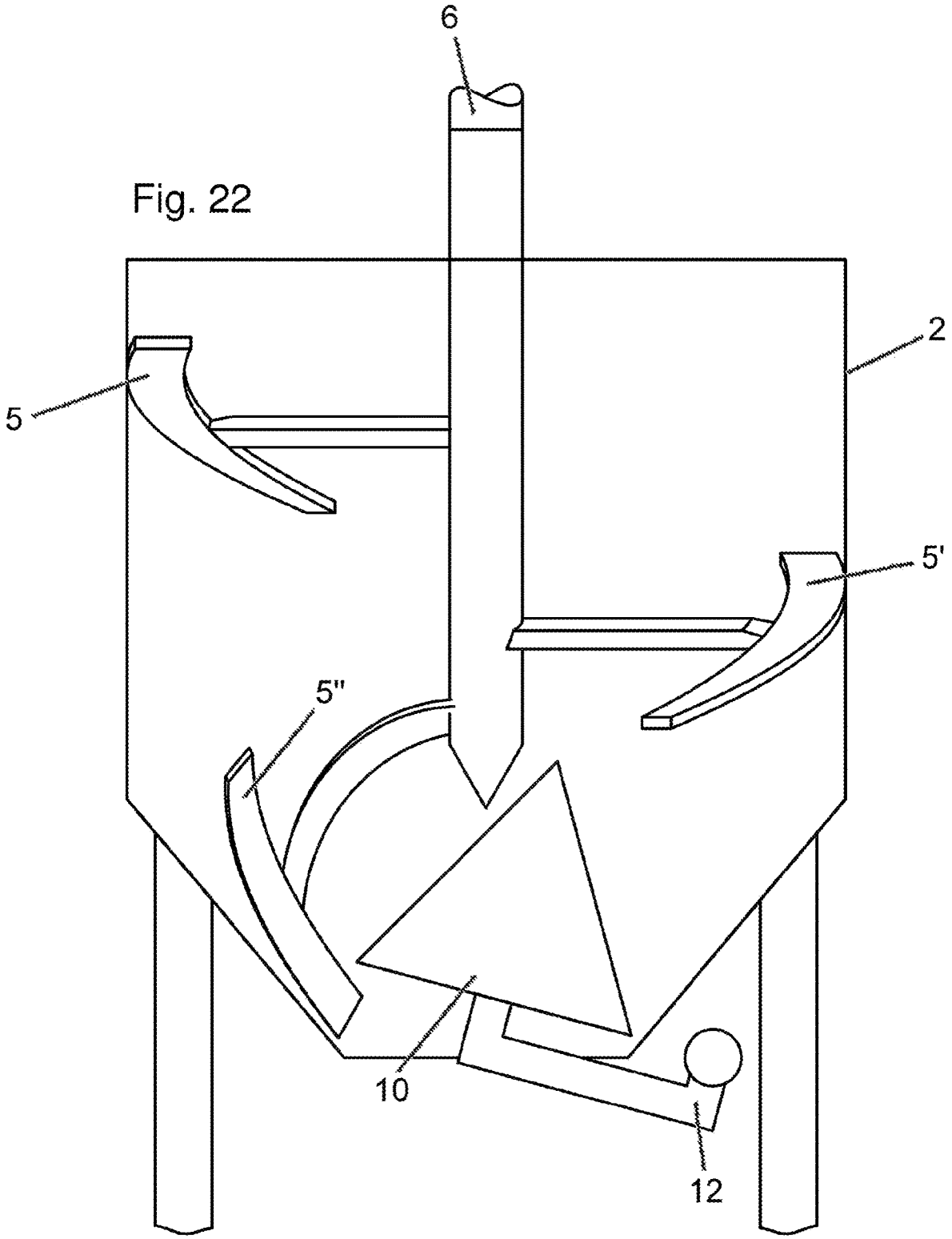
Figure 23:
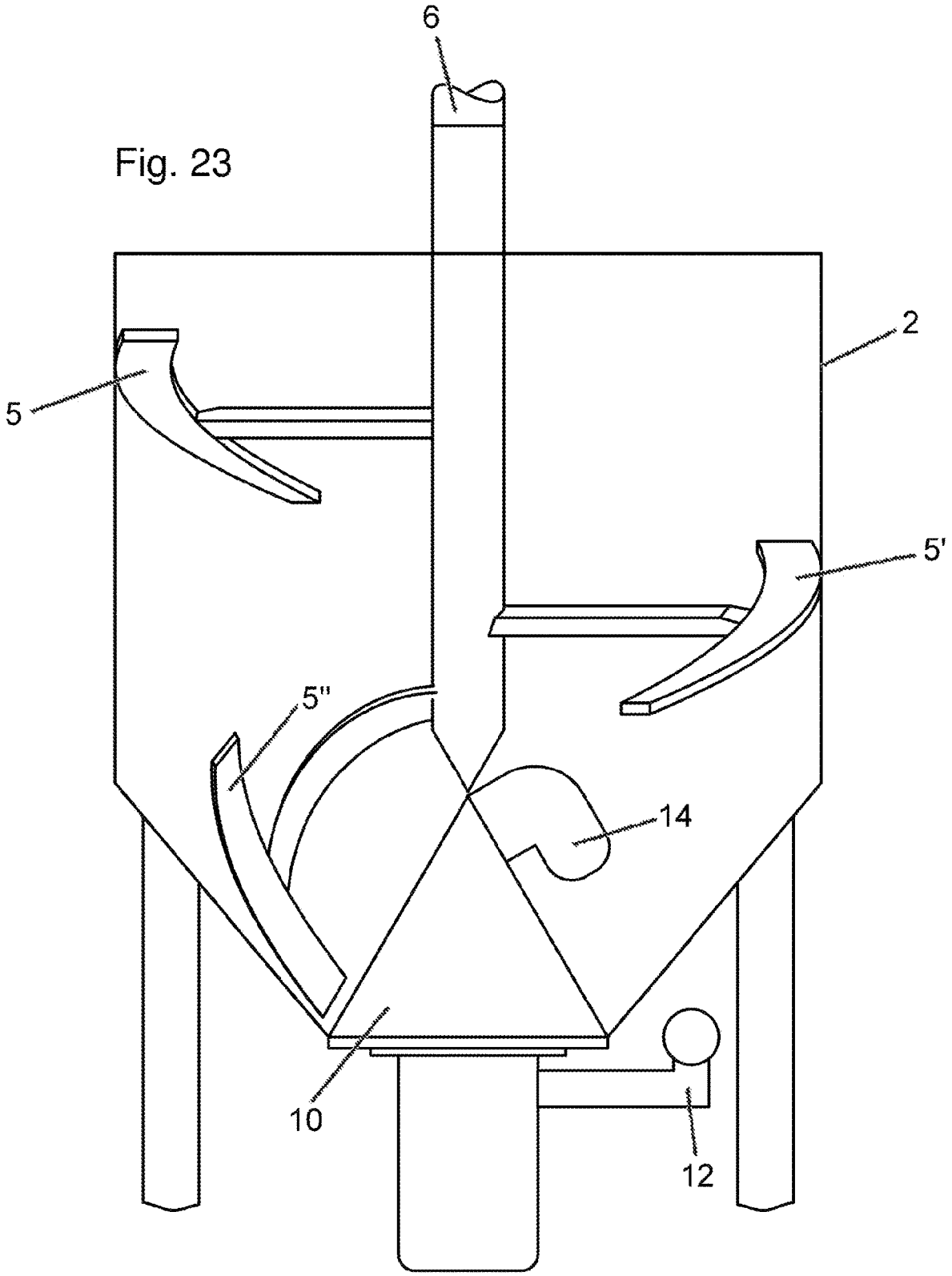
Figure 24:
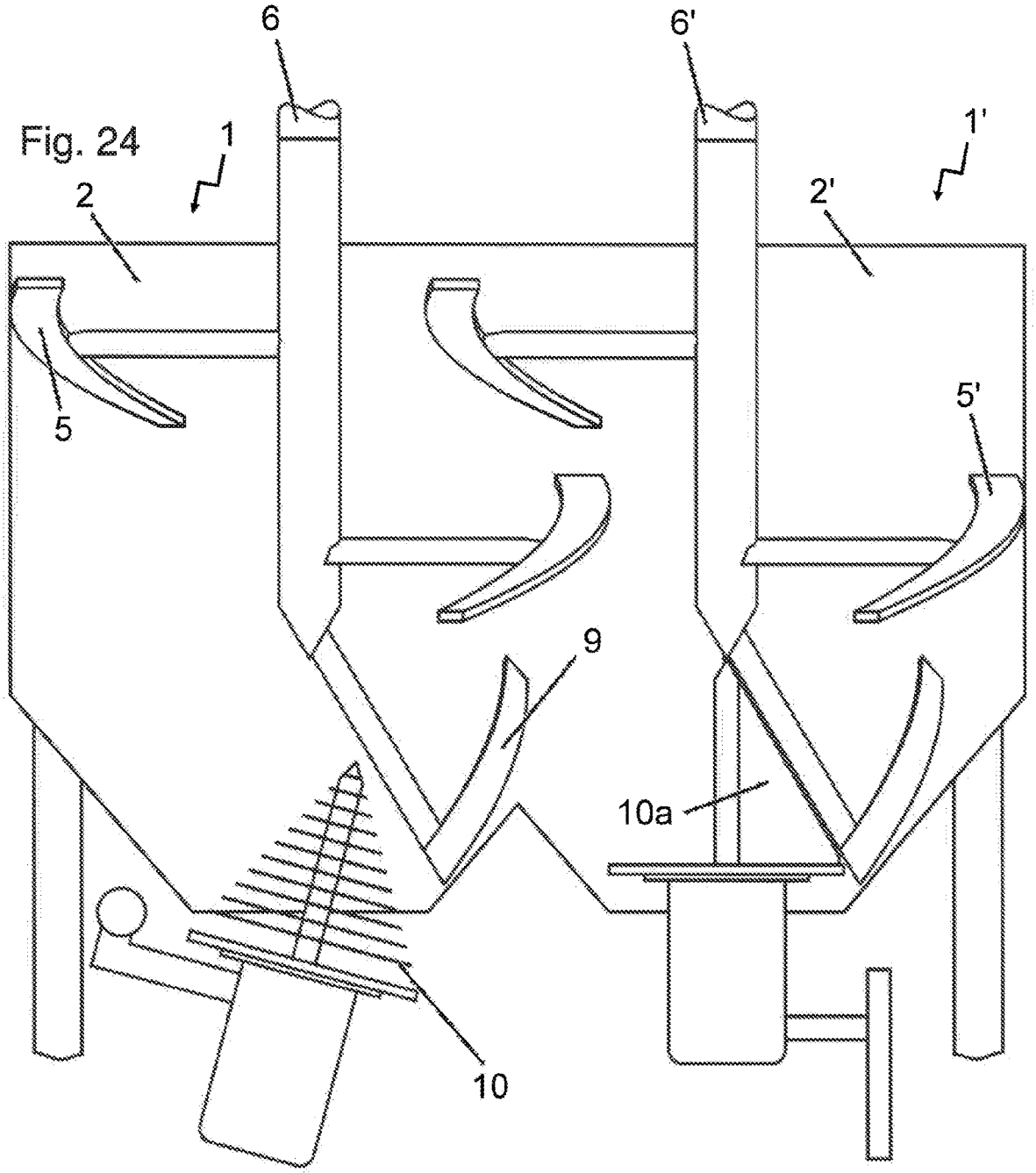
Figure 25:
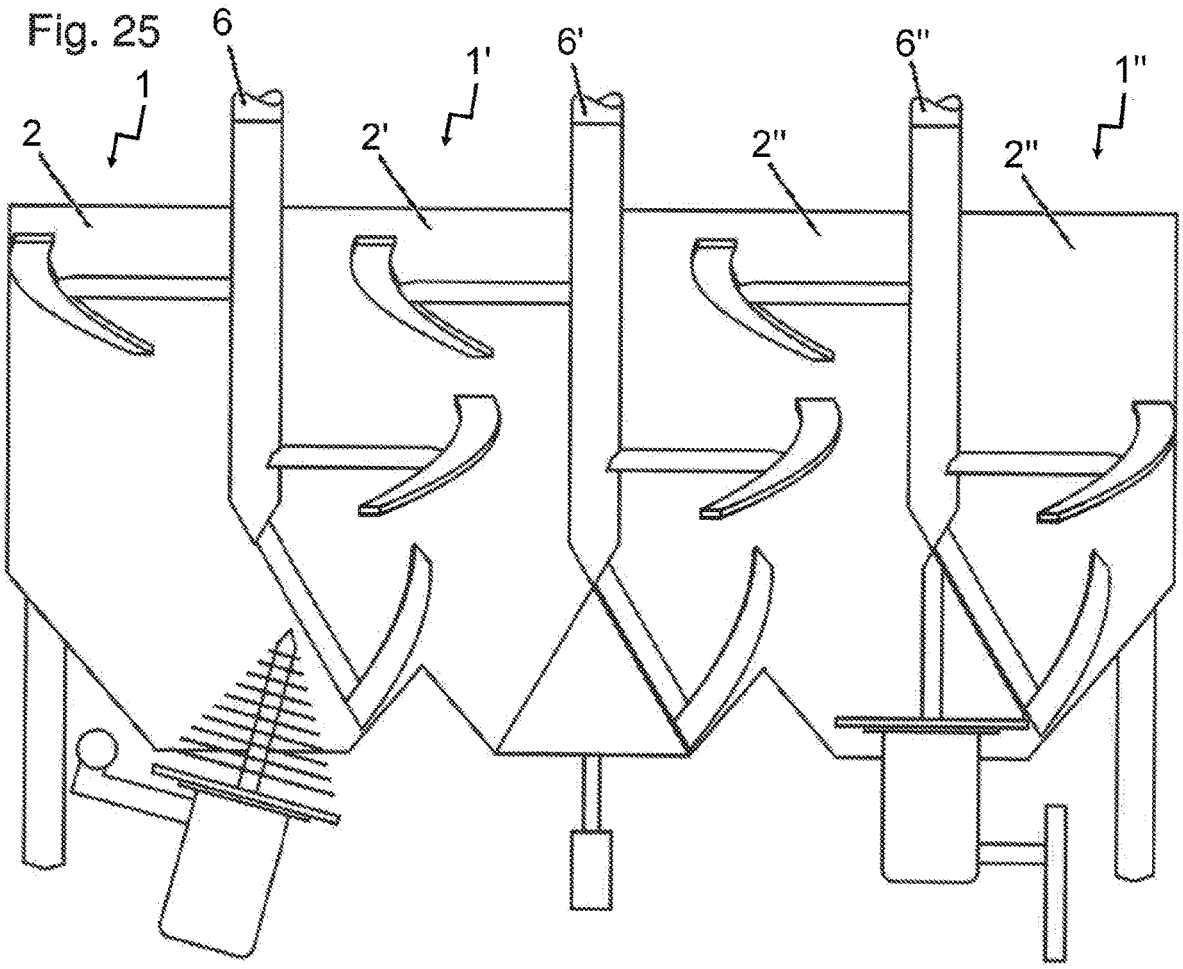
Figure 26:
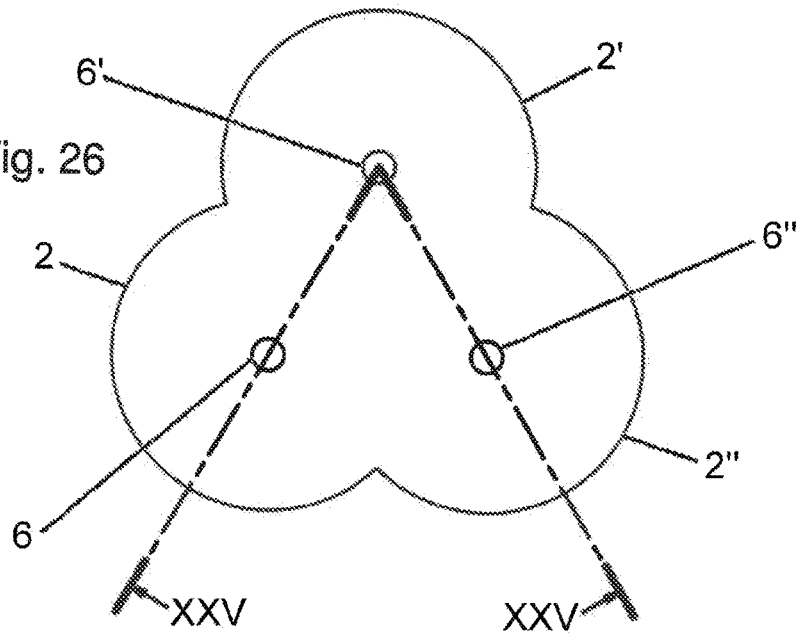
Figure 27:
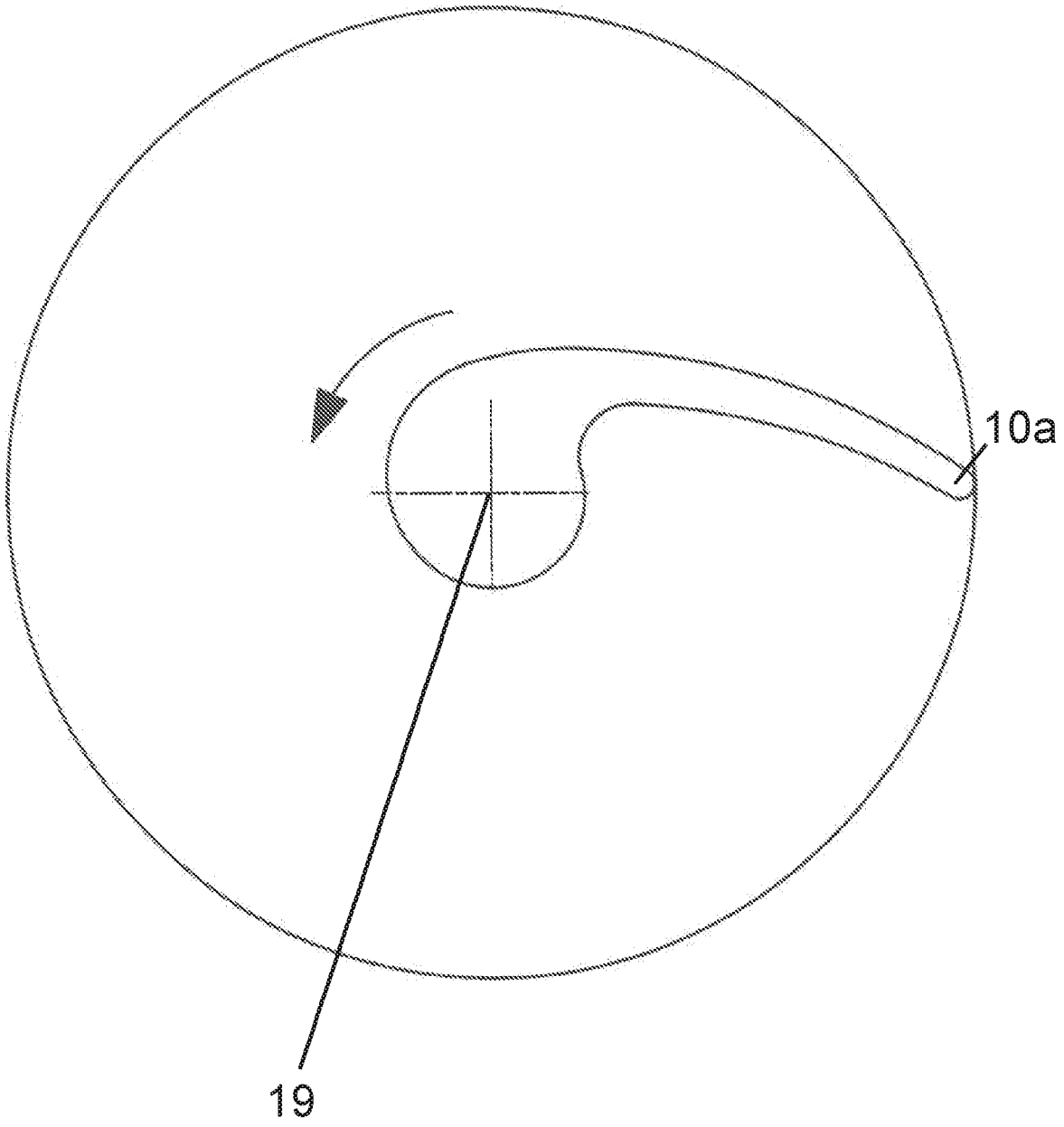
Figure 28:
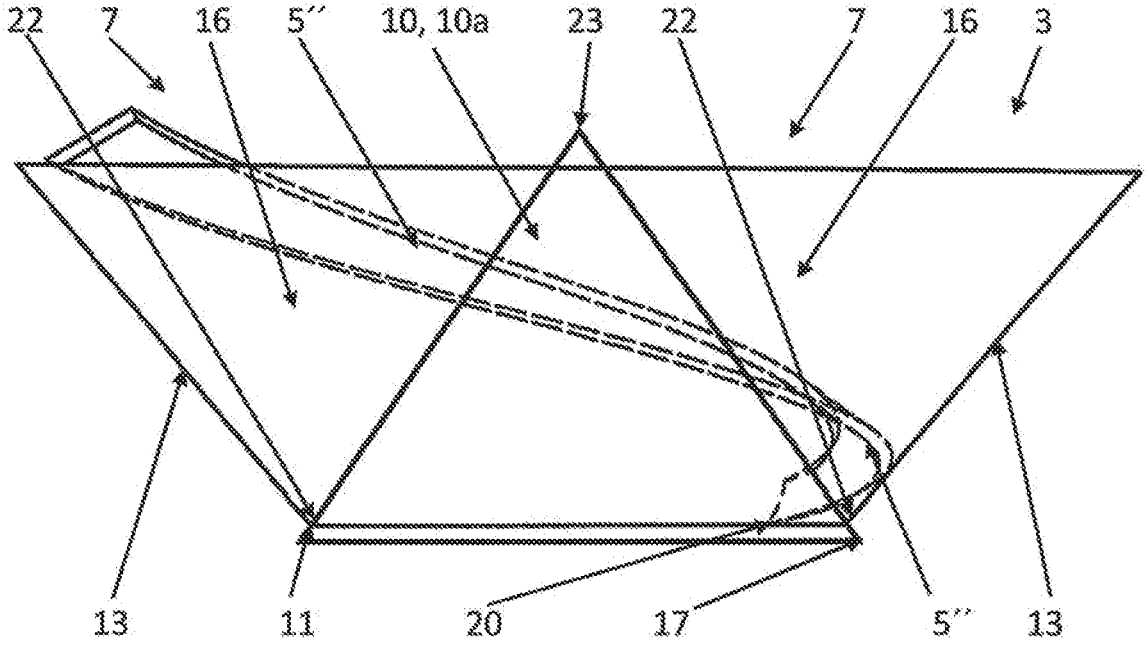
Figure 29:
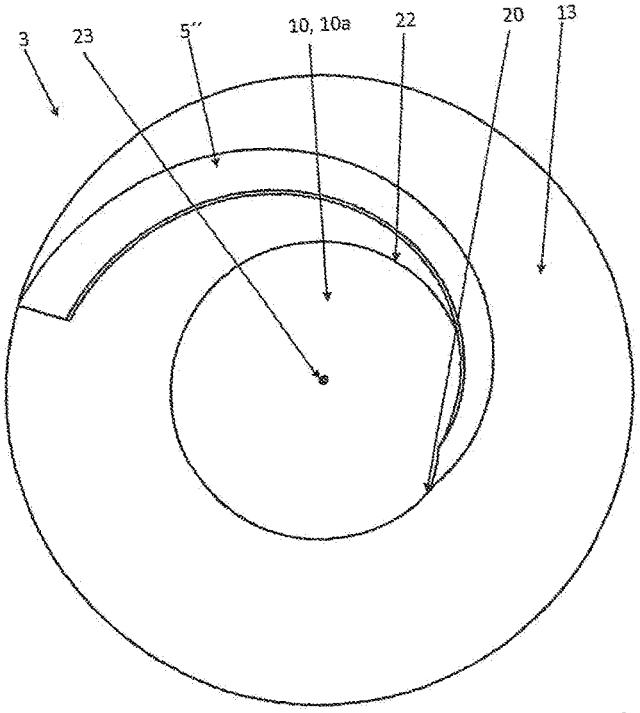
Figure 30:
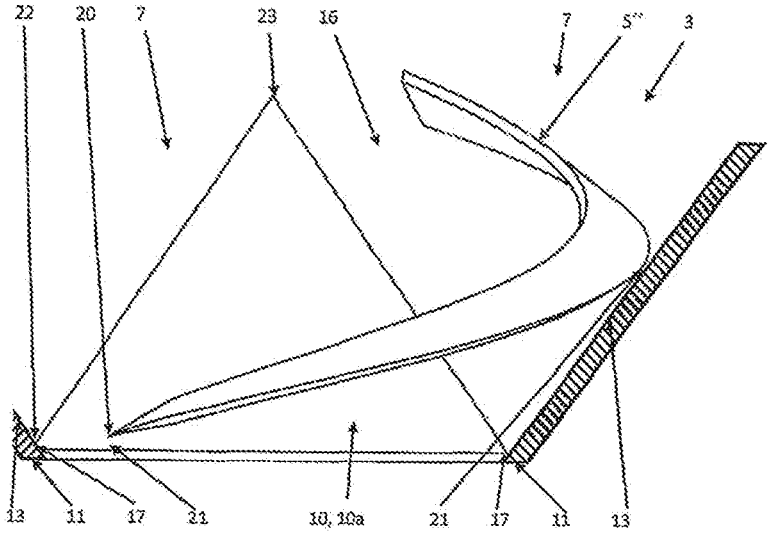
Figure 31:
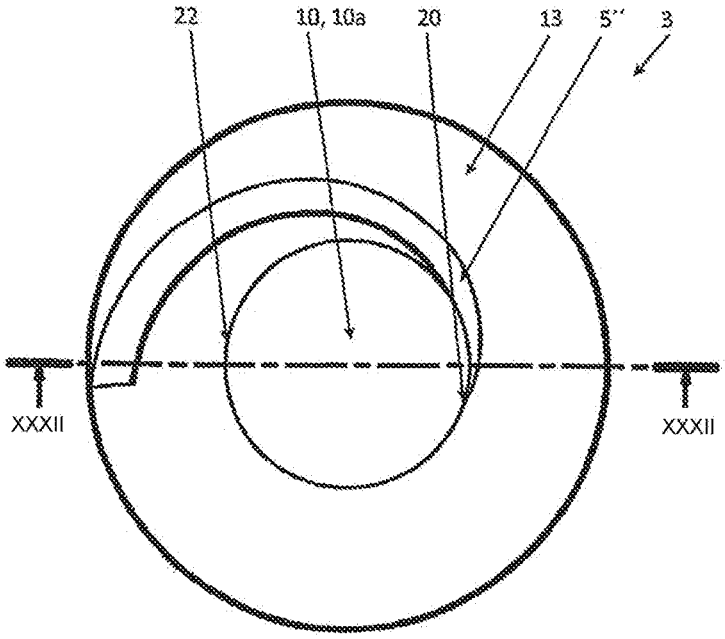
Figure 32:
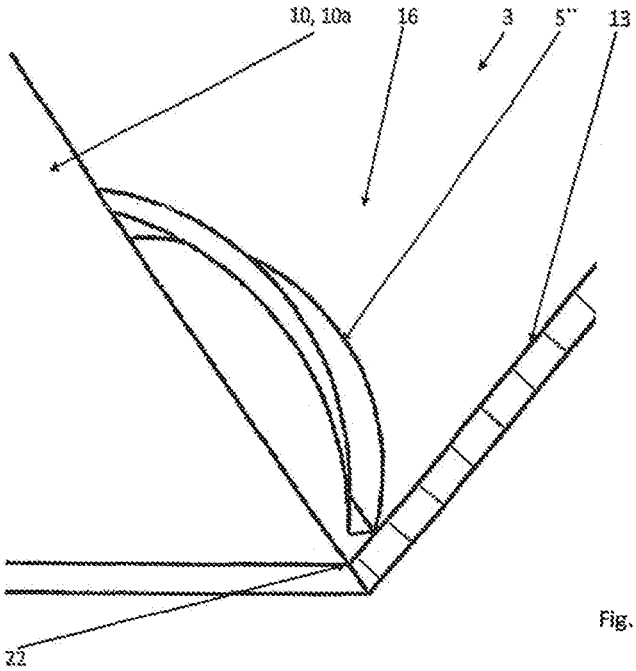
Figure 33:
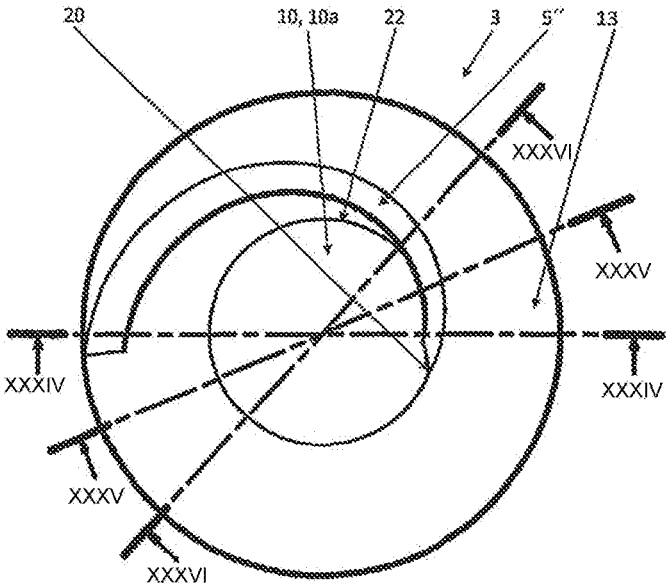
Figure 34:
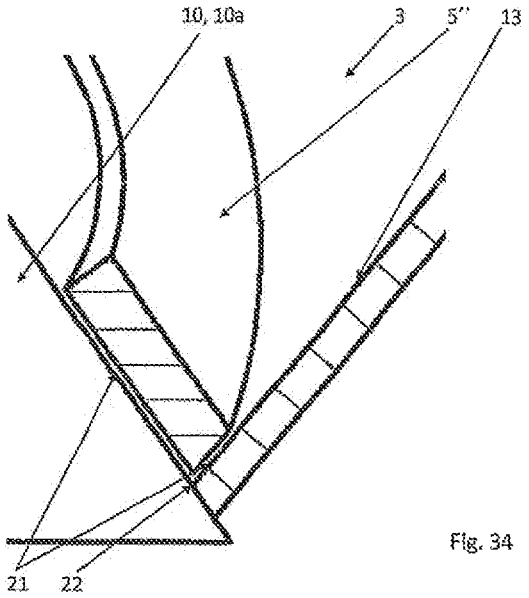
Figure 35:
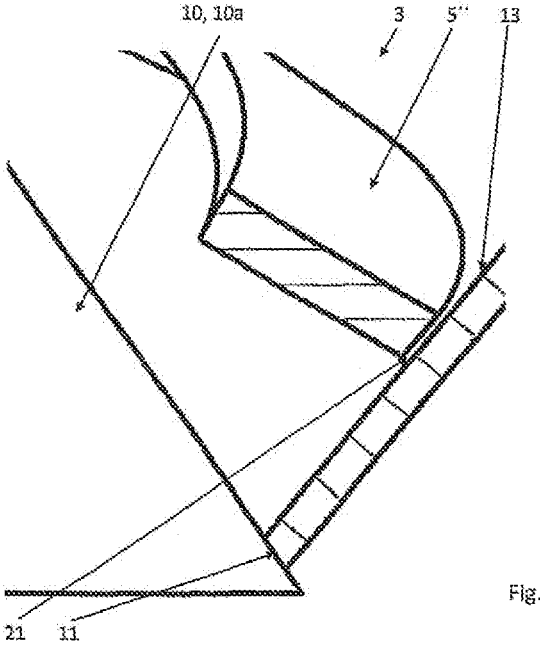
Figure 36:
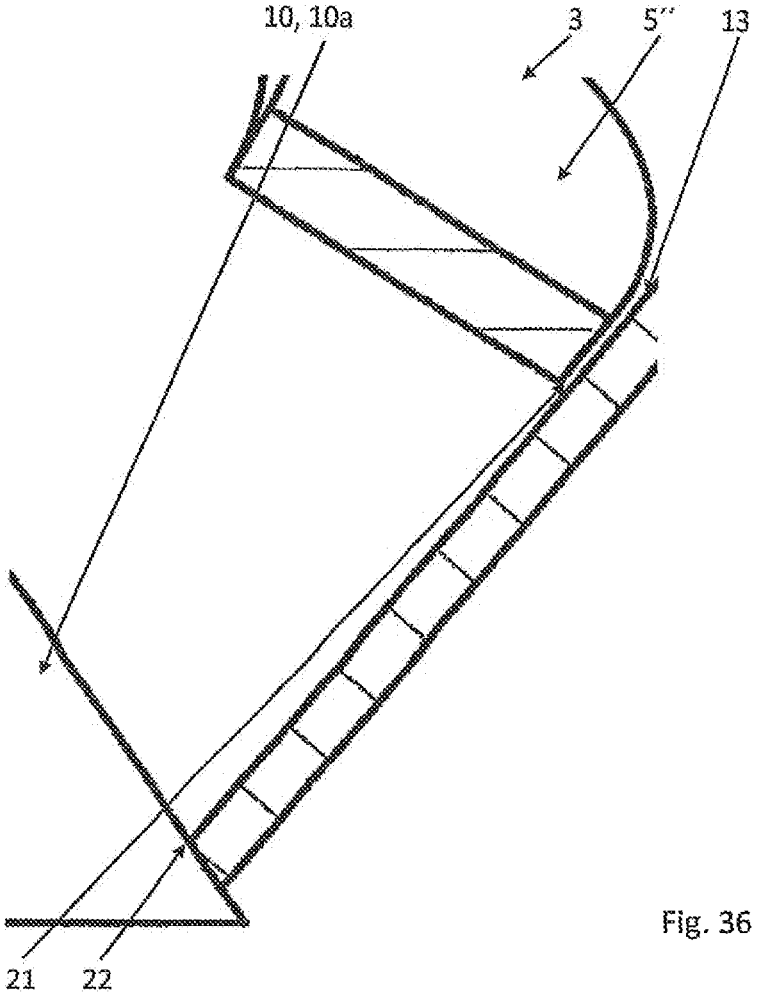
Figure 37:
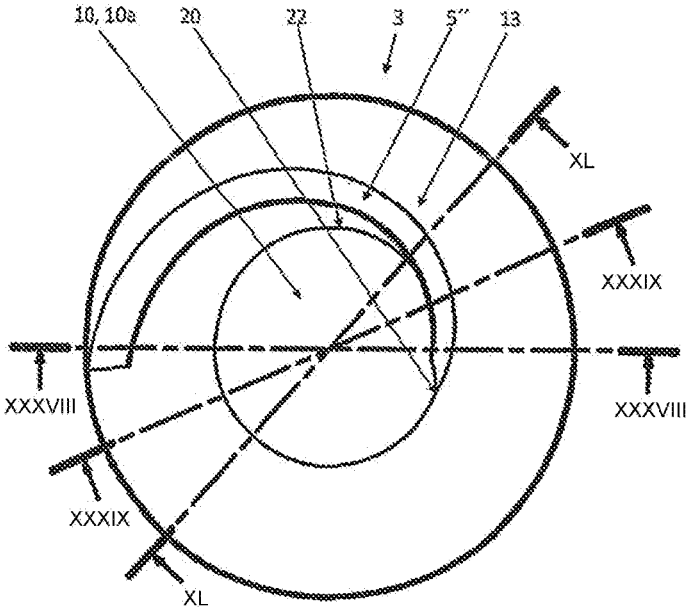
Figure 38:
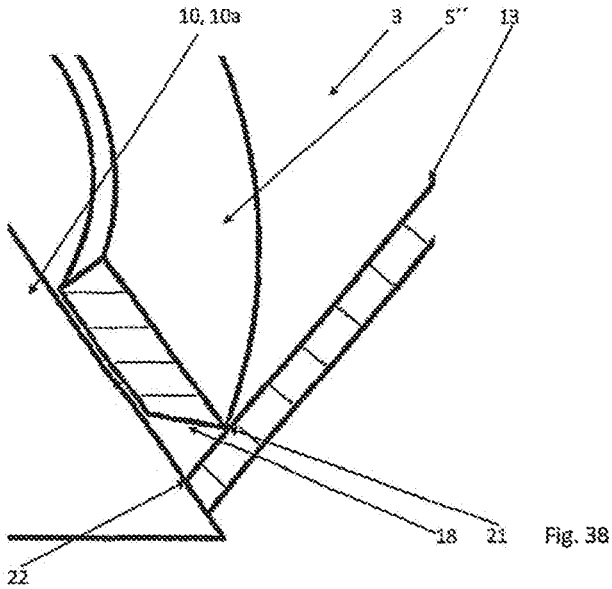
Figure 39:
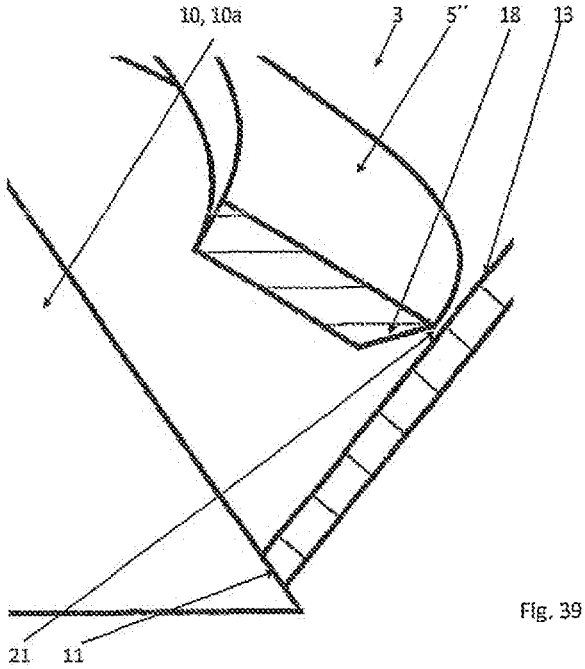
Figure 40:
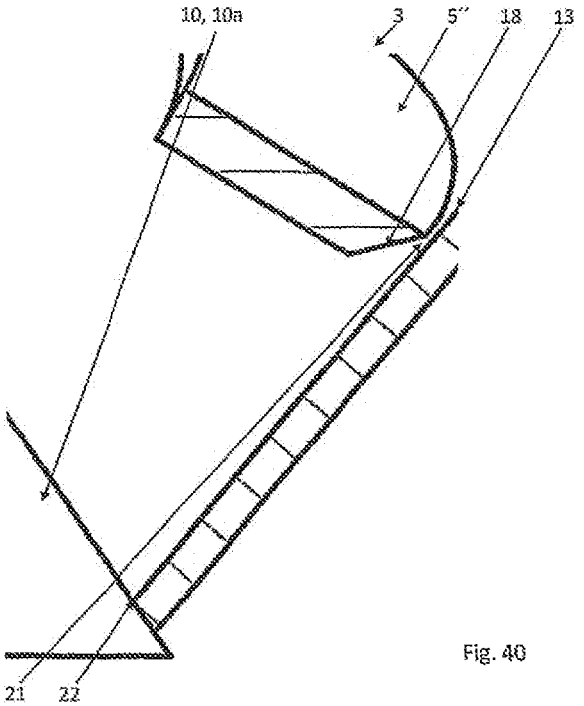
Figure 41:
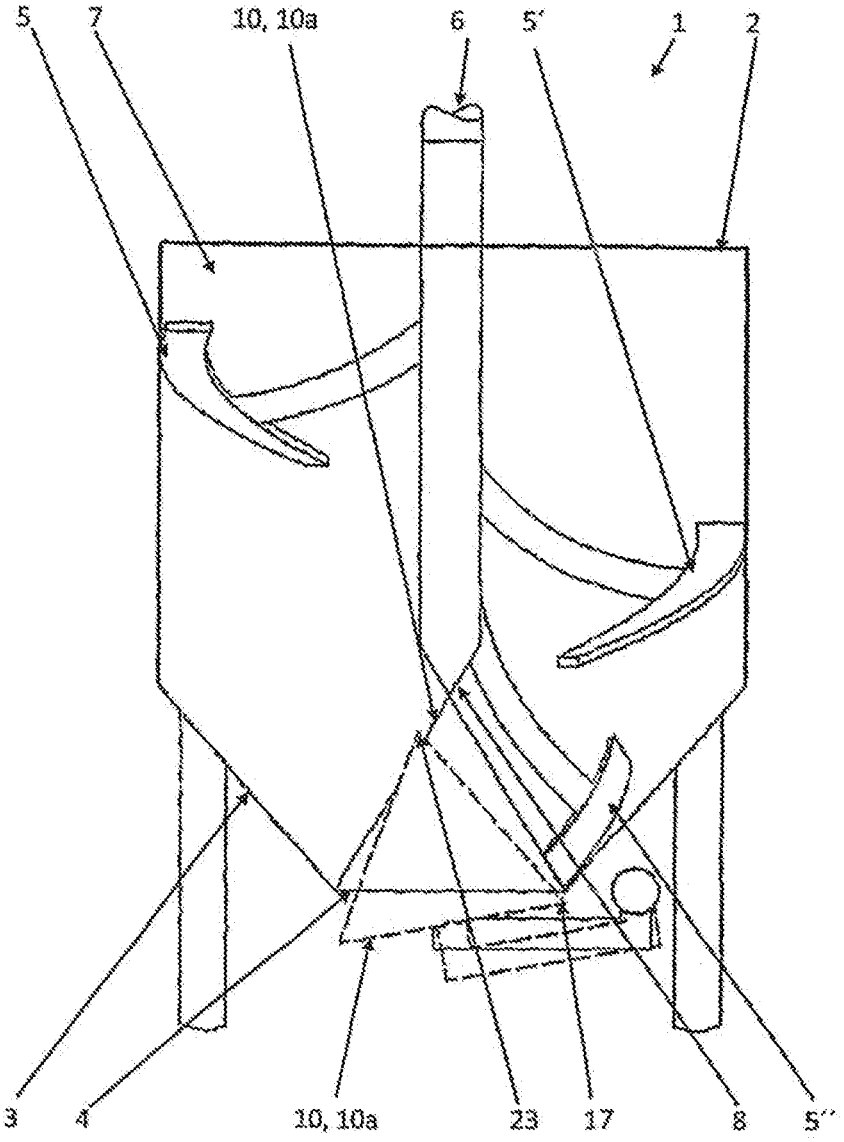
Figure 42:
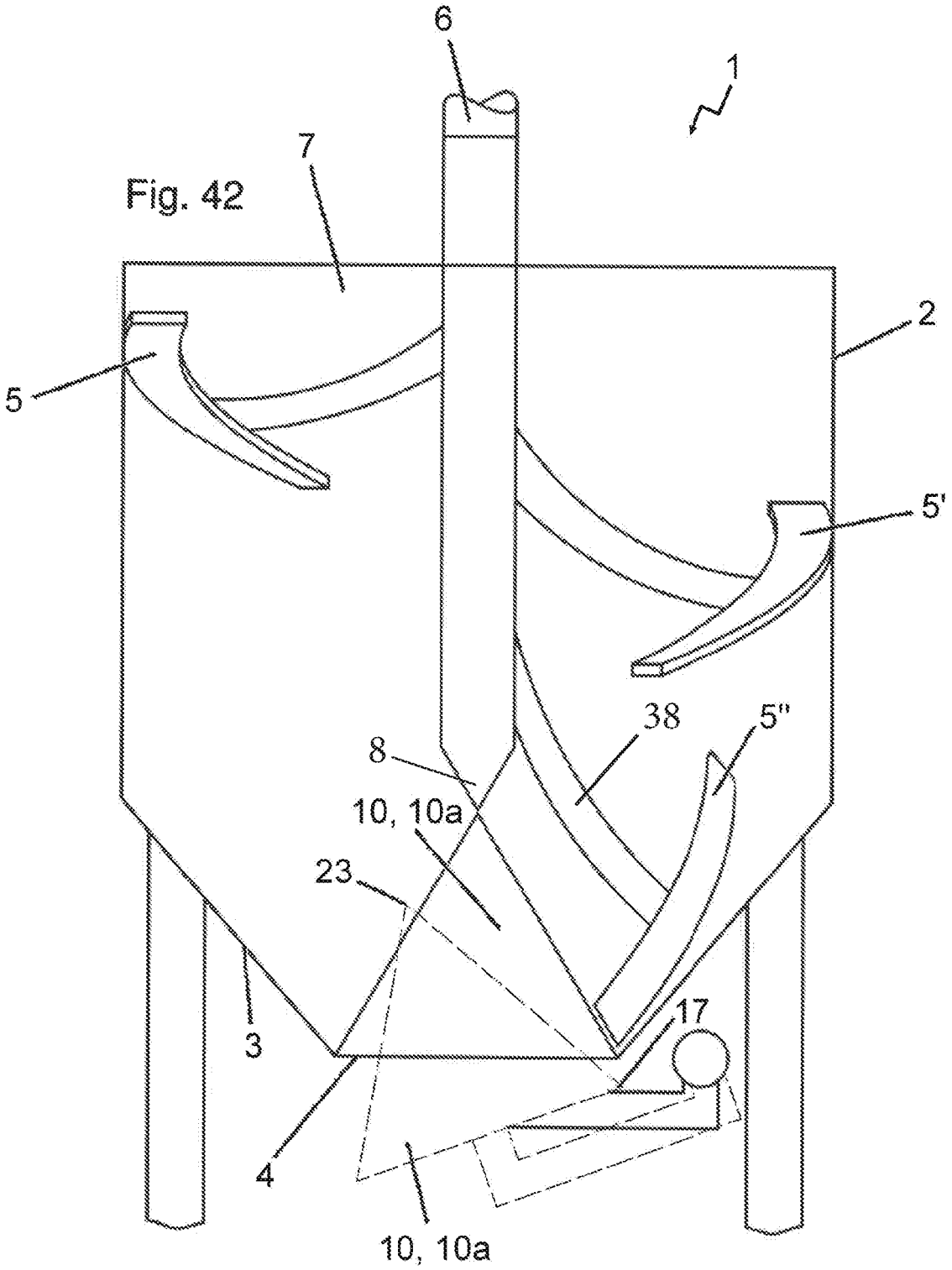

Further characteristics, details, and advantages of the invention are evident on the basis of the following description and using the drawings. Some exemplary embodiments of the invention are explained in greater detail, as examples, using the following drawings. Objects or elements that correspond to one another are provided with the same reference symbols in all the figures. These show:

FIG. 1 a cross-sect ion through an accommodation and dispensing apparatus according to the invention, and a mixing mechanism and a displacer apparatus in the closed position, FIG. 2 a variant of FIG. 1 in the open position, FIG. 3 a further variant in the closed position, FIG. 4 a variant in the closed position, FIG. 5 the variant from FIG. 4 in the open position, FIG. 6 a further variant in an alternative open position, FIG. 7 a variant in the closed position, FIG. 8 a variant according to FIG. 7 in the open position, FIG. 9 a variant according to FIGS. 7 and 8 in an alternative open position, FIG. 10 a variant having a dynamic displacer apparatus, FIG. 11 the variant from FIG. 10 in the open position, FIG. 12 the variant from FIG. 10 in an alternative open position, FIG. 13 a further variant with a dynamic displacer apparatus, FIG. 14 the variant in FIG. 13 in the open position, FIG. 15 the variant from FIG. 13 in an alternative open position, FIG. 16 a variant with an inflated displacer apparatus, FIG. 17 the variant from FIG. 16 with a shrunken displacer apparatus, FIG. 18 an additional, variant in the closed position, FIG. 19 the variant from FIG. 18 in the open position, FIG. 20 the variant from FIG. 18 in an alternative open position, FIG. 21 the variant from FIG. 18 in the open position, with a lifting/rotating movement, FIG. 22 the variant from FIG. 20 with an alternative open position and a lifting/rotating movement, FIG. 23 a further variant with an additional stripper tool on the displacer apparatus, FIG. 24 a double combination of two accommodation and dispensing apparatuses with corresponding different displacer apparatuses, FIG. 25 a triple combination, FIG. 26 a schematic top view of a triple combination, FIG. 27 a top view of a dynamic displacer tool, FIG. 28 a cross-section through the lower region of the accommodation vessel of the accommodation and dispensing apparatus according to the invention, a mixing tool, and a displacer apparatus in the closed position, FIG. 29 top view of the lower region of the accommodation vessel of the accommodation and dispensing apparatus according to the invention, a mixing tool and a displacer apparatus in the closed position, FIG. 30 a further cross-section through the lower region of the accommodation vessel, FIG. 31 a further top view of the lower region of the accommodation vessel, FIG. 32 a detail view of a cross-section through the lower region of the accommodation vessel, FIG. 33 a further top view of the lower region of the accommodation vessel, FIG. 34 a further detail view of a cross-section through the lower region of the accommodation vessel, FIG. 35 a further detail view of a cross-section through the lower region of the accommodation vessel, FIG. 36 a further detail view of a cross-section through the lower region of the accommodation vessel, FIG. 37 a further top view of the lower region of the accommodation vessel, FIG. 38 a further detail view of a cross-section through the lower region of the accommodation vessel, FIG. 39 a further detail view of a cross-section through the lower region of the accommodation vessel, FIG. 40 a further detail view of a cross-section through the lower region of the accommodation vessel, FIG. 41 a cross-section through an accommodation and dispensing apparatus according to the invention and a displacer apparatus with an open position and lifting/rotating movement, FIG. 42 a cross-section through an accommodation and dispensing apparatus according to the invention and a displacer apparatus with an open position and lifting/rotating movement.

An apparatus for accommodation and dispensing of miscible materials, according to the invention, indicated in general with 1, has an essentially cylindrical accommodation vessel 2 having a lower region 3 in the form of a truncated cone, with a lower discharge opening 4 in the direction of gravity, and with a mixing mechanism 5 that circulates in the accommodation vessel 2. The mixing space 7 of the apparatus 1 according to the invention is formed by the accommodation vessel 2 and the lower region 3 in the form of a truncated cone. The circulating mixing mechanism 5 with its additional mixing tools 5', 5" is disposed in this mixing space 7. The mixing mechanism shaft 6 of the mixing mechanism 5, which also serves as a drive shaft for the mixing tools 5', 5", is mounted centrally in the mixing space 7. A mixer drive, not shown in any detail, is situated above on an essentially horizontal pivot axis. The mixing mechanism shaft 6 has at least one mixing mechanism 5 that can also be wound around the mixing mechanism shaft 6 in helix manner, as a helical spiral. A further mixing tool 9 can be disposed at the lower, tapered free tip 8 of the mixing mechanism shaft 6, as the main mixing tool.

According to the invention, the discharge opening 4 is provided with a displacer apparatus 10 that projects into the interior of the lower region 3, in the form of a truncated cone, of the accommodation vessel 2. This apparatus can particularly be structured as a closure cone with an acute angle or a wide angle. Its shape can be structured, for example, to be conical, hyperbola-like, parabola-like, scale-like, dome-like, roof-like, hemispherical, trumpet-shaped, droplet-shaped, in the form of a truncated cone, convex or concave. It is also possible to configure the displacer dynamically, for example approximately in sickle shape 10*a*, as shown, for example, in FIGS. 10 to 15 and FIG. 27.

It is provided, in every case, that the displacer apparatus 10, 10*a* ends by contacting and sealing the lower edge 11 of the vessel wall 13, forming a seal at a circumferential sealing region. It can also be translationally movable into the mixing space 7 or can be lowered out of it.

FIG. 11 shows how the displacer apparatus 10*a* is lowered out of the lower region 3 of the accommodation vessel 2 by a lifting/rotating movement, by means of a rotary lever 12, while FIG. 12 shows how the displacer apparatus 10*a* is moved into the lower region 3 of the open vessel 2 by a lifting/rotating movement. The incline angle of the surface after the lifting/rotating movement should amount to at most 65 degrees relative to the direction of gravity between a lower edge 17 of the displacer apparatus 10, 10*a* and an upper end 23 of the displacer apparatus 10, 10*a*, in order to guarantee fast and thorough emptying even at a low construction space below the discharge opening 4. Alternatively, the displacer apparatus 10*a*, as shown in FIG. 14 as an example, can be translationally lowered out of the mixing space 7, or, as shown in FIG. 15, can be lifted into it. Further translational opening movements are evident from FIGS. 19 and 20, while further lifting/rotating movements are shown in FIGS. 21 and 22.

The displacer apparatus 10 can be structured as a fixed component, on the one hand, but it can also rotate as shown with the reference symbol 10*a* in FIGS. 10 to 15 and 27, in order to improve the mixing performance. It can be formed from a smoothly ground metallic material, as well as from a plastic through which gas can flow. It can be produced both from a solid material and from a hollow material, but also from a flexible material. In this case, it can be inflatable or shrinkable, and can be pushed flexibly inward and pulled out downward. The surface of the displacer apparatus 10 can furthermore have a hydrophobic nanostructure. As a result, the mixed material can slide along the displacer apparatus 10 particularly well, due to gravity, and cleaning is facilitated by this surface.

In every case, it is advantageous if the displacer apparatus 10 is shaped, following the conical wall part of the lower vessel wall 13, in such a manner that the rotating main mixing tool 5" or 9 can take up the mixed material free of dead space, and in stress-free manner. The Lower vessel wall 13 and the cylindrical accommodation vessel 2 can also have a surface having a hydrophobic nanostructure.

In an embodiment, it is provided that the displacer apparatus 10 is stripped off by the rotating main mixing tool 5". Furthermore, a mixing tool 14 can additionally be disposed on the displacer apparatus 10, as is evident from FIG. 23. If necessary, liquid can be added by way of a lance 15 on the displacer apparatus 10.

The significant advantage of the apparatus according to the invention consists in that the mixed material, which essentially flows down in the center, along the mixing mechanism shaft 6, which serves as the drive shaft of the mixing tools 5', 5", is guided, at the bottom of the accommodation vessel 2, which ends in the shape of a truncated cone, by the mixing mechanism shaft 6, in other words the axle of rotation of the mixing mechanism 5, to the periphery, where upward flow takes place. As a result, all the mixed materials situated in the mixing space 7 can reliably flow through both the zones of slight mixing and the zones of intensive mixing. This is guaranteed in that the main mixing tool 5", in other words the lower end of the mixing screw or the lowermost element of the mixing mechanism 5, projects into the approximately V-shaped channel 16 between lower vessel wall 13 and displacer apparatus 10. In this regard, the displacer apparatus 10 can be both a dynamic element 10*a* and a static element 10. In every case, it is ensured that all the particles participating in the formulation come into relative motion with regard to the adjacent particles, in each instance. The problems that have existed until now in the case of vertical mixers having a conical outlet or an outlet in the form of a truncated cone, which problems consist in that the materials situated in the center practically only turn in a circle, are solved in simple and effective manner.

The accommodation apparatus 1 can be simply opened and emptied in the manner described, specifically without residue. This can be done either in that the displacer apparatus 10 is lowered below the discharge opening 4 or displaced info the interior of the accommodation vessel 2, specifically either by means of a translational movement or a lifting/rotating movement. Alternatively, it is provided that the displacer apparatus 10 can be flexibly inflated or shrunken, as shown in FIGS. 16 and 17, so that it also allows exit of the mixed material from the accommodation container 2 when gas or air are let out. This task can also be accomplished in that the displacer apparatus 10 can be flexibly turned inward into the lower region 3 or pulled out downward. Any mixed material that might still be adhering to it can be loosened in that the displacer apparatus 10 can be excited using vibration technology. Also, it is provided that the displacer apparatus 10 is stripped off by the rotating main mixing tool 9.

Particular advantages occur if two apparatuses 1, 1', 1" according to the invention are combined with one another, as shown in FIG. 24. Three apparatuses according to the invention can also be combined with one another, as is evident from FIG. 25 and FIG. 26, with FIG. 25 showing the view through the section planes XXV-XXV of FIG. 26. In both cases, the mixer outputs can be further increased and the mixing times can be shortened, in part. The mixing tools 5', 5" are disposed on the respective mixing shafts 6, 6', 6", driven and controlled in such a manner that they do not collide with one another and cannot hook into one another. The same holds true for the main mixing tool 5" that projects into the channel 16, which is approximately V-shaped in cross-section, between lower vessel wall 13 and the displacer apparatus 10, in other words the lower end of the mixing screw or the lowermost element of the mixing mechanism 5. Particular advantages occur if the mixing mechanism 5 also has a hydrophobic nanostructure on its surface.

FIG. 28 shows a cross-section through the lower region 3 of the accommodation vessel of the accommodation and dispensing apparatus 1 according to the invention (FIG. 1), the main mixing tool 5" and the displacer apparatus 10, 10*a* in the closed position. As can be seen, the main mixing tool 5" of the mixing mechanism 5 (FIG. 1) projects into the channel 16, which is approximately V-shaped in cross-section, between lower vessel wall 13 and the displacer apparatus 10, 10*a*. The main mixing tool 5" is shown with a broken line in the region in which it projects into the channel 16, which is approximately V-shaped in cross-section. The main mixing tool 5" projects into the channel 16, which is approximately V-shaped in cross-section, in such a manner that, the lower end of the main mixing tool 5" reaches all the way to just barely above the bottom 22 of the channel 16, which is approximately V-shaped in cross-section, which bottom is formed by the edge 11 between the lower vessel wall 13 and the displacer apparatus 10, 10*a*. Furthermore, the main mixing tool 5" is formed in such a manner that it takes up the mixed material at the bottom 22 of the channel 16, which is approximately V-shaped in cross-section. For this purpose, the tip 20 of the main mixing tool 5" reaches all the way to the bottom 22 of the channel 16, which is approximately V-shaped in cross-section. In the example shown, the main mixing tool 5" strips the displacer apparatus 10, 10*a* off only in the lower region part of the displacer apparatus 10, 10*a*, so that the mixed material that trickles down or flows down from above, onto the displacer apparatus 10, 10*a*, is guided by the displacer apparatus 10, 10*a*, out of the center of the mixing space 7 into its periphery, solely due to gravity. There, the mixed material is taken up by the main mixing tool 5" and conveyed upward again. For this purpose, the rotating main mixing tool 5" is adapted to the contour of the lower vessel wall 13 and shaped contour-parallel corresponding to the lower vessel wall 13. In the exemplary embodiment, the main mixing tool 5", which can be the lower end of a mixing screw or a mixing spiral of the mixing mechanism 5 (FIG. 1), is structured as a helical spiral or mixing mechanism coil. In the representation according to FIGS. 28, 29, and 33 to 40, the displacer apparatus 10, 10*a* is situated in the closed position, so that a sealing zone is formed between the lower edge 11 of the vessel wall 13 and the displacer apparatus 10, 10*a*, which zone closes off the discharge opening 4 (FIG. 2). In this exemplary embodiment, the sealing zone is disposed above the lower edge 17 of the displacer apparatus 10, 10*a*. Furthermore, in this exemplary embodiment the sealing zone forms the bottom 22 of the channel 16, which is approximately V-shaped in cross-section. In the exemplary embodiment shown in FIG. 28, the discharge opening 4 (FIG. 2) can be opened in that the displacer apparatus 10, 10*a* is lowered below the discharge opening 4 (FIG. 2).

FIG. 29 shows a top view from the direction of the lower free tip 8 (FIG. 1) of the lower region 3, shown in FIG. 28, of the accommodation vessel 2 (FIG. 1) of the accommodation and dispensing apparatus 1 according to the invention (FIG. 1), and the main mixing tool 5" and a displacer apparatus 10, 10*a* in the closed position. As can be seen in FIG. 23, the main mixing tool 5" projects into the channel 16, which is approximately V-shaped in cross-section (FIG. 28), in such a manner that a tip 20 of the main mixing tool 5", as the lower end of the main mixing tool 5", reaches all the way to the bottom 22 of the channel 16, which is approximately V-shaped in cross-section, which bottom is formed by the edge 11 (FIG. 28) between the lower vessel wall 13 and the displacer apparatus 10, 10*a*. In this regard, the main mixing tool 5" is formed in such a manner that it can take up the mixed material at the bottom 22 of the Channel 16, which is approximately V-shaped in cross-section (FIG. 28). For this purpose, the main mixing tool 5" has a tip 20 that reaches all the way to the bottom 22 of the channel 16, which is approximately V-shaped in cross-section (FIG. 28). In a lower region part, the main mixing tool 5" strips off the displacer apparatus 10, 10*a*. For this purpose, the tip 20 of the main mixing tool 5" is also adapted to the contour of the displacer apparatus 10, 10*a* in this region. Because the main mixing tool 5" is formed contour-parallel, corresponding to the lower vessel wall 13, the mixed material is reliably conveyed upward along the lower vessel wall 13 during rotation of the main mixing tool 5" about the mixing mechanism shaft 6 (FIG. 1).

A further cross-section through the lower region 3 of the accommodation vessel 1 (FIG. 1) is shown in FIG. 30. In this regard, however, the focus was placed on the representation of the placement of the main mixing tool 5" in the channel 16, which is approximately V-shaped in cross-section (FIG. 29), so that FIG. 30 shows only a detail of the lower region 3. It is advantageous if the mixed material taken up by the main mixing tool 5" is conveyed upward along the lower vessel wall 13, after it has trickled down or flowed down along the mixing mechanism shaft 6 (FIG. 1) and guided from the center of the mixing space 7 (FIG. 1) to its periphery by the displacer apparatus 10, 10*a*. In order to guarantee effective conveying of the mixed material by the main mixing tool 5", the gap 21 between the lower vessel wall 13 and the main mixing tool 5" is slight, i.e. the main mixing tool 5" is adapted to the contour of the lower vessel wall 13, and the main mixing tool 5" is formed contour-parallel, corresponding to the lower vessel wall 13. In FIG. 30, as well, the displacer apparatus 10, 10*a* is shown in the closed position. In the exemplary embodiment shown here, the discharge opening 4 (FIG. 2) can be opened in that the displacer apparatus 10, 10*a* can be pushed into the interior of the accommodation vessel 2 (FIG. 1). Here, the displacer apparatus 10, 10*a*, with its lower edge 17, forms a sealing zone with the lower vessel wall 13, in the closed position. It can furthermore be seen that the lower end of the main mixing tool 5", in other words the tip 20, reaches all the way to barely above the bottom 22 of the channel 16, which is approximately V-shaped in cross-section and is formed by the edge between the lower vessel wall 13 and the lower edge 17 of the displacer apparatus 10, 10*a*. The gap 21 that occurs here between main mixing tool 5" and the bottom 22 of the channel 16, which is approximately V-shaped in cross-section, is selected in such a manner that the mixed material that is situated on the bottom 22 is taken up. The tip 20 of the main mixing tool 5" is furthermore formed in such a manner that acquisition of the mixed material takes place in stress-free manner. As a result, the mixed material does not undergo any further stress but rather is handled gently. The gap 21 and the tip 20 should therefore be dimensioned as a function of the accommodated mixed material, in other words as a function of the size and the state of the mixed material, so that acquisition of the mixed material, free of dead space and in stress-free manner is guaranteed.

FIG. 31 shows a further top view of the lower region 3 of the accommodation vessel 2 (FIG. 1). Similar to FIG. 29, the perspective from which the lower region 3 is looked at is the direction in which the lower free tip 8 (FIG. 1) projects. The cross-sectional plane that is shown in the detail of FIG. 32 is indicated with the broken line that carries the designation XXXII-XXXII. In the exemplary embodiment, the main mixing tool 5" continuously narrows to a point. With its tip 20, the main mixing tool 5", as already described above, projects into the channel 16, which is approximately V-shaped in cross-section (FIG. 28), between lower vessel wall 13 and the displacer apparatus 10, 10*a*.

The detail in FIG. 32 shows a detailed cross-section through the lower region 3 of the accommodation vessel 2 (FIG. 1) in the section plane designated with XXXII-XXXII in FIG. 31. As can be seen, the tip 20 (FIG. 31) of the main mixing tool 5", as the lower end of the main mixing tool 5", projects all the way to just above the bottom 22 of the channel 16, which is approximately V-shaped in cross-section and is formed by the edge between the lower vessel wall 13 and the displacer apparatus 10, 10*a*.

FIG. 33 shows a further top view, similar to FIGS. 29 and 31, of the lower region 3 of the accommodation vessel 2 (FIG. 1). The perspective of the top view is selected as in FIGS. 29 and 31. In FIG. 33, three section planes XXXIV-XXXIV, XXXV-XXXV, and XXXVI-XXXVI are drawn in; these are shown as details in FIGS. 34, 35, and 36. In the exemplary embodiment, the main mixing tool 5" narrows to a point, wherein the tip 20 of the main mixing tool 5" is adapted to the form of the displacer apparatus 10, 10*a*. The main mixing tool 5", as already described above, projects with its tip 20 into the channel 16, which is approximately V-shaped in cross-section (FIG. 28), between lower vessel wall 13 and the displacer apparatus 10, 10*a*.

In the detail in FIG. 34, a detailed sectional representation through the lower region 3 of the accommodation vessel 2 (FIG. 1) is shown in the section plane designated as XXXIV-XXXIV in FIG. 33. The main mixing tool 5" projects into the channel 16, which is approximately V-shaped in cross-section (FIG. 28), in such a manner that only a small gap 21 remains between displacer apparatus 10, 10*a*, the lower vessel wall 13, and the main mixing tool 5". In this way, it can be ensured that the mixed material on the bottom 22 of the channel 16, which is approximately V-shaped in cross-section (FIG. 28), is also taken up. In this way, it is guaranteed that the mixed material is taken up by the main mixing tool 5" without any dead space. Here, the displacer apparatus 10, 10*a* is stripped off by the main mixing tool 5" in a lower region part, while this does not happen in the upper region part of the displacer apparatus 10, 10*a*. In this upper region part, the mixed material only slides along the displacer apparatus 10, 10*a* due to gravity.

In the detail of FIG. 35, a detailed sectional representation through the lower region 3 of the accommodation vessel 2 (FIG. 1) is shown in the section plane designated as XXXV-XXXV in FIG. 33. Because of the contour-parallel corresponding shape, a gap 21 that remains uniform over the tool length also exists at this location of the main mixing tool 5". As can be seen, the gap 21 between the lower vessel wall 13 and the main mixing tool 5" is selected to be so small that effective conveying of the mixed material by the main mixing tool 5", along the lower vessel wall 13, is guaranteed. For this purpose, the main mixing tool 5" is adapted to the contour of the lower vessel wall 13.

In the detail of FIG. 36, a detailed sectional representation through the lower region 3 of the accommodation vessel 2 (FIG. 1) is shown in the section plane designated as XXXVI-XXXVI in FIG. 33. At this location, as well, a corresponding gap 21 exists between the main mixing tool 5" and the lower vessel wall 13.

FIG. 37 shows a further top view, similar to FIGS. 31 and 33, of the lower region 3 of the accommodation vessel 2 (FIG. 1). The perspective of the top view is selected as in FIGS. 31 and 33. In FIG. 37, three section planes XXXVIII-XXXVIII, XXXIX-XXXIX, and XL-XL are also drawn in, which are shown as details in FIGS. 38, 39, and 40. In the exemplary embodiment, the main mixing tool 5" narrows to a point, wherein the tip 20 of the main mixing tool 5" is adapted to the form of the displacer apparatus 10, 10*a*. As already described above, the main mixing tool 5", with its tip 20, projects into the channel 16, which is approximately V-shaped in cross-section (FIG. 28), between lower vessel wall 13 and the displacer apparatus 10, 10*a*.

In the detail in FIG. 38, a detailed sectional representation through the lower region 3 of the accommodation vessel 2 (FIG. 1) is shown in the section plane designated as XXXVIII-XXXVIII in FIG. 37. The main mixing tool 5" projects into the channel 16, which is approximately V-shaped in cross-section (FIG. 28), in such a manner that only a small gap 21 remains between displacer apparatus 10, 10*a*, the lower vessel wall 13, and the main mixing tool 5". Here, the displacer apparatus 10, 10*a* is stripped off by the main mixing tool 5" in a lower region part, while this does not happen in the upper region part of the displacer apparatus 10, 10*a*. Differing from the exemplary embodiment according to FIG. 34, a clearance angle 18 is disposed between the lower vessel wall 13 and the main mixing tool 5". This clearance angle 18 is disposed in such a manner that conveying of the mixed material along the lower vessel wall 13 can take place in stress-free manner. Thus, mixed material parts that get into the gap 21 between lower vessel wall 13 and main mixing tool 5" are not stressed further but treated gently by the free angle 18 that lies behind them in the conveying direction. Mixed material parts that were not taken up during the first rotation of the main mixing tool 5" are taken up during one of the following rotations and conveyed upward. In this way, stress-free acquisition of the mixed material by the main mixing tool 5" is guaranteed.

In the detail of FIG. 39, a detailed sectional representation through the lower region 3 of the accommodation vessel 2 (FIG. 1) is shown in the section plane designated as XXXIX-XXXIX in FIG. 37. The gap 21 between the lower vessel wall 13 and the main mixing tool 5" is selected to be so small that effective conveying of the mixed material by the main mixing tool 5", along the lower vessel wall 13, is guaranteed. With the clearance angle 18 between main mixing tool 5" and lower vessel wall 13, it is furthermore guaranteed that acquisition of the mixed material by the main mixing tool 5" takes place in stress-free manner along the lower vessel wall 13.

In the detail of FIG. 40, a detailed sectional representation through the lower region 3 of the accommodation vessel 2 (FIG. 1) is shown in the section plane designated as XL-XL in FIG. 37. At this location, as well, a corresponding gap 21 having a clearance angle 18 exists between the main mixing tool 5" and the lower vessel wall 13.

FIGS. 41 and 42 show an apparatus 1 according to the invention having a cylindrical accommodation vessel 2 with a lower region 3 in the form of a truncated cone and a lower discharge opening 4 in the direction of gravity. The displacer apparatus 10, 10*a* that projects into the interior of the lower region 3 closes off the discharge opening 4 in the closed position. The displacer apparatus 10, 10*a* is shown in an open position with a broken line, wherein the opening angle is different in FIGS. 41 and 42. Here, the opening angle occurs by means of a lifting/rotating movement, during which the displacer apparatus 10, 10*a* is lowered out of the lower region 3 of the accommodation vessel 2. In FIG. 41, an opening angle of about 15 degrees is shown, whereas in FIG. 42, an opening angle of 20 degrees is shown. Even at an opening angle of 30 degrees, the incline of the surface between a lower edge 17 of the displacer apparatus 10, 10*a* should have an angle of at most 65 degrees relative to the direction of gravity after the lifting/rotating movement. The incline of the surface with which the displacer apparatus 10, 10*a* projects into the lower region of the accommodation vessel should therefore amount to about 25 degrees or more relative to a horizontal plane that lies orthogonal to the direction of gravity, even in the open position. The mixing mechanism includes a first arm 38 attached to the mixing mechanism shaft 6. The main mixing tool 5" is attached to the first arm 38. The first arm 38 extends at a continuously downward angle from the mixing mechanism shaft 6 towards the lower vessel wall 13. The main mixing tool has a tip 20 disposed directly above the circumferential sealing region. The mixing mechanism shaft 6 terminates in the lowered, tapered free tip 8 that is disposed adjacent the upper end 23 of the displacer apparatus 10

Of course, the invention is not restricted to the exemplary embodiments shown. Further embodiments are possible without departing from the basic idea. Thus, it is also possible, for example, to configure the displacer apparatus 10 dynamically, not statically. In this case, a displacer apparatus 10*a* rotates about its own axis 19, as shown in FIGS. 10 to 15 and 27, for example. For this purpose, a separate drive with gear mechanism can be provided in the displacer apparatus 10*a*. Furthermore, at least one dynamic additional tool can be provided. Furthermore, the material that can be mixed using the apparatus according to the invention can be not only moist materials but also, above all, powders or solid small-format bodies.

REFERENCE SYMBOL LIST

1 apparatus
2 accommodation vessel
3 lower region in the form of a truncated cone
4 discharge opening
5 mixing mechanism
5' mixing tool
5" main mixing tool
6 mixing mechanism shaft
6', 6" mixing mechanism shafts
7 mixing space
8 free lower tip
9 mixing tool
10 displacer apparatus
10*a* displacer apparatus
11 lower edge
12 rotary lever
13 lower vessel wall, conical wall
15 lance
16 channel with V-shaped cross-section
17 lower edge of the displacer apparatus
18 free angle
19 axis of the displacer apparatus
20 tip of the main mixing tool
21 gap
22 bottom of the V-shaped channel
23 upper end of the displacer apparatus
38 first arm

The invention claimed is:

1. Apparatus for accommodation and dispensing of miscible materials, having a cylindrical accommodation vessel having a lower region in the form of a truncated cone, which region has a lower discharge opening in a direction of gravity, and having a mixing mechanism shaft disposed centrally in a mixing space, which shaft has at least one mixing mechanism that revolves in the accommodation vessel, wherein the discharge opening is provided with a displacer apparatus that projects into the interior of the lower region of the accommodation vessel, and wherein a main mixing tool of the mixing mechanism projects into a channel that is approximately V-shaped in cross-section, between a lower vessel wall and the displacer apparatus, wherein the displacer apparatus contacts and seals a lower edge of the lower vessel wall at a circumferential sealing region, wherein the displacer apparatus is movable into the lower region of the accommodation vessel or lowered out of the lower region of the accommodation vessel via a lifting and rotating movement, wherein the displacer apparatus can be lowered below the discharge opening to open the discharge opening, wherein the main mixing tool extends downwards towards a center of the lower discharge opening, wherein the displacer apparatus comprises an inclined surface, the inclined surface projecting into the lower region of the accommodation vessel, wherein an incline of the inclined surface amounts to twenty-five degrees or more relative to a horizontal plane, the horizontal plane lying orthogonal to the direction of gravity, wherein the at least one mixing mechanism comprises a first arm attached to the mixing mechanism shaft, the main mixing tool being attached to the first arm, wherein the first arm extends at a continuously downward angle from the mixing mechanism shaft towards the lower vessel wall, wherein the main mixing tool has a tip disposed directly above the circumferential sealing region, wherein the mixing mechanism shaft terminates in a tapered free tip disposed adjacent an upper end of the displacer apparatus.

2. Apparatus according to claim 1, wherein the displacer apparatus is disposed within the mixing space.

3. Apparatus according to claim 1, wherein the displacer apparatus is structured as a rotating component.

4. Apparatus according to claim 3, wherein a drive motor and a gear mechanism are disposed in the displacer apparatus.

5. Apparatus according to claim 1, wherein the displacer apparatus is produced from a smoothly ground metallic material.

6. Apparatus according to claim 1, wherein the displacer apparatus is produced from a plastic through which gas can flow.

7. Apparatus according to claim 1, wherein the displacer apparatus is produced from a flexible material.

8. Apparatus according to claim 1, wherein the displacer apparatus can be flexibly inflated or shrunken.

9. Apparatus according to claim 1, wherein the displacer apparatus can be flexibly turned inward and pulled out at the bottom.

10. Apparatus according to claim 1, wherein the displacer apparatus is excited using vibration technology.

11. Apparatus according to claim 1, wherein the displacer apparatus is shaped, subsequent to the lower vessel wall, in such a manner that the rotating main mixing tool can take up the mixed material without any dead space and in stress-free manner.

12. Apparatus according to claim 1, wherein at least two accommodation vessels that overlap in certain regions, having at least two mixing mechanisms that circulate in the respective accommodation vessel are combined.

13. Apparatus according to claim 1, wherein at least one lance for addition of liquid to the displacer apparatus is provided.

14. Apparatus according to claim 1, wherein a static mixing tool is attached to the displacer apparatus.

15. Apparatus according to claim 1, wherein the displacer apparatus guides the mixed material from the center of the mixing space into its periphery, where the material is taken up by the main mixing tool and conveyed upward.

16. Apparatus according to claim 1, wherein the main mixing tool is shaped contour-parallel corresponding to the lower vessel wall.

17. Apparatus according to claim 1, wherein a clearance angle is disposed between the lower vessel wall and the main mixing tool.

18. Apparatus according to claim 1, wherein the incline of the surface between a lower edge of the displacer apparatus and the upper end of the displacer apparatus has an angle of at most 65 degrees relative to the direction of gravity after the lifting and rotating movement.

19. Apparatus according to claim 1, further comprising a gap between the inclined surface of the displacer apparatus and the main mixing tool, the gap extending between the tip of the main mixing tool and the displacer apparatus.

* * * * *